US011994144B2

(12) United States Patent
He

(10) Patent No.: US 11,994,144 B2
(45) Date of Patent: May 28, 2024

(54) BLOWER SYSTEM WITH AN INNER AXIAL FAN BLADE SET AND AN OUTER CENTRIFUGAL FAN BLADE SET

(71) Applicant: Dell Products, LP, Round Rock, TX (US)

(72) Inventor: Qinghong He, Austin, TX (US)

(73) Assignee: DELL PRODUCTS LP, Round Rock, TX (US)

( * ) Notice: Subject to any disclaimer, the term of this patent is extended or adjusted under 35 U.S.C. 154(b) by 0 days.

(21) Appl. No.: 17/085,258

(22) Filed: Oct. 30, 2020

(65) Prior Publication Data

US 2022/0136520 A1 May 5, 2022

(51) Int. Cl.

| | |
|---|---|
| ***F04D 29/28*** | (2006.01) |
| ***F04D 29/32*** | (2006.01) |
| ***F04D 29/62*** | (2006.01) |
| ***F04D 29/64*** | (2006.01) |

(52) U.S. Cl.

CPC ..... *F04D 29/281* (2013.01); *F04D 29/325* (2013.01); *F04D 29/624* (2013.01); *F04D 29/644* (2013.01)

(58) Field of Classification Search

CPC .... F04D 17/164; F04D 19/007; F04D 25/166; F04D 29/181; F04D 29/242; F04D 29/281; F04D 29/30; F04D 29/325; F04D 29/388; F04D 29/422; F04D 29/4246

See application file for complete search history.

(56) References Cited

U.S. PATENT DOCUMENTS

| | | | | |
|---|---|---|---|---|
| 2,330,938 | A | 10/1943 | Williams | |
| 3,592,260 | A | 7/1971 | Berger | |
| 3,950,112 | A | 4/1976 | Crump | |
| 5,966,286 | A * | 10/1999 | O'Connor | G06F 1/203 361/679.55 |
| 6,021,042 | A | 2/2000 | Anderson | |
| 6,210,118 | B1 * | 4/2001 | Egawa | F04D 29/281 416/243 |
| 6,318,976 | B1 * | 11/2001 | Hsieh | F04D 29/057 310/90 |
| 6,328,097 | B1 | 12/2001 | Bookhardt | |
| 6,373,700 | B1 | 4/2002 | Wang | |
| 6,457,955 | B1 * | 10/2002 | Cheng | F04D 25/066 165/122 |
| 6,525,936 | B2 | 2/2003 | Beitelmal | |
| 6,567,269 | B2 | 5/2003 | Homer | |
| 6,652,223 | B1 | 11/2003 | Horng | |
| 6,789,999 | B2 | 9/2004 | Bikos | |
| 6,989,988 | B2 | 1/2006 | Arbogast | |

(Continued)

*Primary Examiner* — Brian P Wolcott
(74) *Attorney, Agent, or Firm* — Prol Intellectual Property Law, PLLC; H. Kenneth Prol

(57) ABSTRACT

An information handling system may include a processor, a memory, and a power source operatively coupled in a base chassis; a blower system including a shaft operatively coupled to a blower motor; a hub operatively coupled to the shaft; an outer centrifugal blower blade set forming a monolithic piece with an inner axial blower blade set and hub, the inner axial blower blade set to increase the redirection of an incoming airflow via an inlet in a blower housing to the outer centrifugal blower blade set and air outlet in the blower housing, the outlet airflow direction in a plane of rotation of the blower system.

20 Claims, 13 Drawing Sheets

(56) References Cited

U.S. PATENT DOCUMENTS

| | | | | |
|---|---|---|---|---|
| 7,008,189 | B2 * | 3/2006 | Jarrah | F04D 29/281 415/206 |
| 7,051,791 | B2 * | 5/2006 | Hashimoto | F04D 19/002 165/80.3 |
| 7,071,587 | B2 | 7/2006 | Lopatinsky | |
| 7,079,388 | B2 | 7/2006 | Faneuf | |
| 7,079,394 | B2 | 7/2006 | Mok | |
| 7,134,839 | B2 * | 11/2006 | Horng | F04D 25/166 415/199.4 |
| 7,192,254 | B2 * | 3/2007 | Li | F04D 29/282 415/199.1 |
| 7,215,543 | B2 | 5/2007 | Arbogast | |
| 8,104,295 | B2 | 1/2012 | Lofy | |
| 8,142,147 | B2 | 3/2012 | O'Connor | |
| 9,317,090 | B2 * | 4/2016 | Culbert | G05D 23/24 |
| 9,845,805 | B2 | 12/2017 | Bhutani | |
| 9,850,907 | B2 * | 12/2017 | Kadijk | H01L 23/467 |
| 10,485,135 | B2 | 11/2019 | He | |
| 10,539,150 | B2 | 1/2020 | Ling | |
| 10,584,717 | B1 | 3/2020 | He | |
| 10,687,440 | B1 | 6/2020 | He | |
| 10,982,684 | B2 * | 4/2021 | Lin | F04D 17/16 |
| 11,118,598 | B2 * | 9/2021 | Kennedy | F04D 17/167 |
| 2002/0172008 | A1 | 11/2002 | Michael | |
| 2003/0161102 | A1 | 8/2003 | Lee | |
| 2003/0220721 | A1 | 11/2003 | Cohen | |
| 2004/0099404 | A1 | 5/2004 | Cipolla | |
| 2006/0078428 | A1 | 4/2006 | Zheng | |
| 2006/0193113 | A1 | 8/2006 | Cohen | |
| 2006/0263210 | A1 | 11/2006 | Wang | |
| 2007/0160462 | A1 | 7/2007 | Tsang | |
| 2007/0227699 | A1 | 10/2007 | Nishi | |
| 2007/0268668 | A1 | 11/2007 | Lin | |
| 2008/0035315 | A1 | 2/2008 | Han | |
| 2008/0229758 | A1 | 9/2008 | Lin | |
| 2009/0266518 | A1 | 10/2009 | Huang | |
| 2009/0324403 | A1 | 12/2009 | Zheng | |
| 2010/0071875 | A1 | 3/2010 | Hwang | |
| 2011/0097195 | A1 | 4/2011 | Horng | |
| 2011/0110774 | A1 | 5/2011 | Horng | |
| 2011/0203295 | A1 | 8/2011 | Hsu | |
| 2011/0251733 | A1 | 10/2011 | Atkinson | |
| 2011/0272120 | A1 | 11/2011 | Joshi | |
| 2013/0011255 | A1 | 1/2013 | Horng | |
| 2013/0243628 | A1 | 9/2013 | Zheng | |
| 2014/0063726 | A1 | 3/2014 | Liu | |
| 2014/0092556 | A1 | 4/2014 | Turney | |
| 2014/0185240 | A1 | 7/2014 | Macdonald | |
| 2015/0003974 | A1 | 1/2015 | Heymann | |
| 2015/0116928 | A1 | 4/2015 | Delano | |
| 2016/0003261 | A1 | 1/2016 | Tamaoka | |
| 2016/0037683 | A1 | 2/2016 | Tamaoka | |
| 2016/0369811 | A1 | 12/2016 | Ling | |
| 2017/0359920 | A1 | 12/2017 | Huang | |
| 2019/0008073 | A1 | 1/2019 | He | |
| 2019/0072112 | A1 * | 3/2019 | Lin | F04D 29/281 |
| 2019/0184868 | A1 | 6/2019 | Kim | |
| 2020/0027808 | A1 | 1/2020 | Subrahmanyam | |
| 2020/0110451 | A1 | 4/2020 | He | |

* cited by examiner

BLOWER SYSTEM WITH AN INNER AXIAL FAN BLADE SET AND AN OUTER CENTRIFUGAL FAN BLADE SET

FIELD OF THE DISCLOSURE

The present disclosure generally relates to a thermal control system for an information handling system. The present disclosure more specifically relates to a blower system having improved blade design within a thermal control system of an information handling system.

BACKGROUND

As the value and use of information continues to increase, individuals and businesses seek additional ways to process and store information. One option available to clients is information handling systems. An information handling system generally processes, compiles, stores, and/or communicates information or data for business, personal, or other purposes thereby allowing clients to take advantage of the value of the information. Because technology and information handling may vary between different clients or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific client or specific use, such as e-commerce, financial transaction processing, airline reservations, enterprise data storage, or global communications. In addition, information handling systems may include a variety of hardware and software components that may be configured to process, store, and communicate information and may include one or more computer systems, data storage systems, and networking systems. The information handling system may include telecommunication, network communication, and video communication capabilities. Several components of an information handling system may generate heat which may require cooling systems to mitigate. Further, the information handling system may include a blower used to cool the components within the information handling system such as a processing device and power systems, among others.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings may indicate similar or identical items.

DETAILED DESCRIPTION OF THE DRAWINGS

Figure 1:
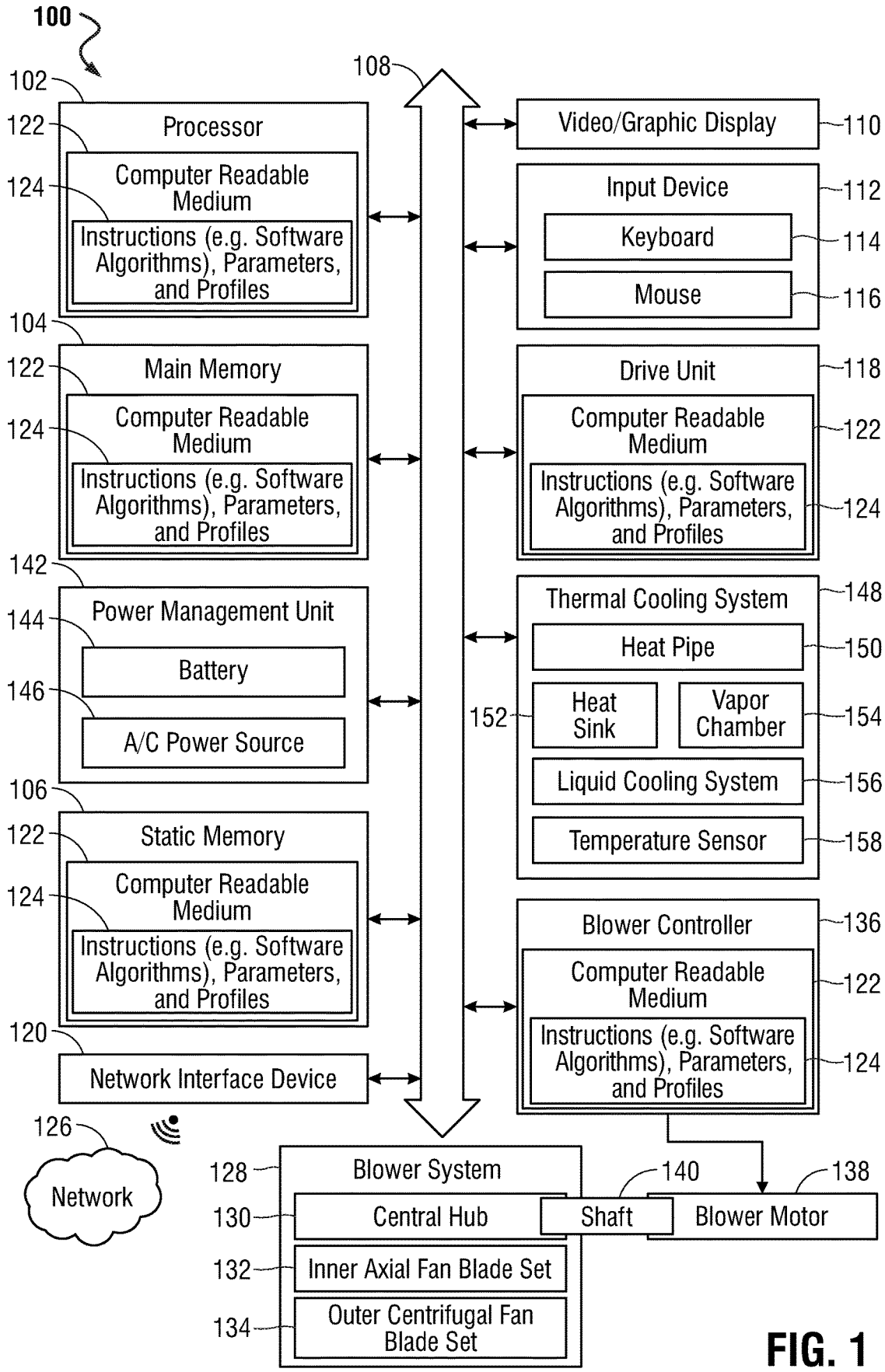
FIG. 1 is a block diagram illustrating an information handling system according to an embodiment of the present disclosure.

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

The drawings provided with this application provide reference cartesian coordinate axes that describe example spatial arrangements of the blower and its elements as described herein. In an embodiment, the plane formed along the Z-axis and Y-axis is referred herein as the "frontal plane." Additionally, the plane formed along the Z-axis and X-axis is referred herein as the "longitudinal plane." Further, the plane formed along the Y-axis and X-axis is referred herein as the "transverse plane." In some embodiments, an intersection between the frontal plane and longitudinal plane may have a common axis at a physical, mechanical drive axis of the blower described herein. This is done for ease of understand and reference various elements within the blower relative to the mechanical axis of the blower as the z-axis. In the present specification and in the claims, the terms "bottom," "top," "distal," "proximal," and their derivatives are defined relative to the mechanical axis of the blower being described at any given time. In the embodiments described herein, a proximal end of a blade of the blower may be operatively coupled to a central hub affixed to the mechanical axis of the blower whereas a distal end of that blade may be furthest away from the central hub and mechanical axis. As used herein, the terms "axial", "radial", "tangential", "inner", "outer", and their derivatives are defined relative to the main axis of the central hub to which the blades are operatively coupled to. The term "radial plane" may be a plane that is parallel to the transverse plane and may radiate away from the intersection between the frontal plane and the longitudinal plane.

Embodiments of the present disclosure provide for an information handling system 100 that includes a processor, a memory, and a power source as well as control for a thermal control system including a blower therein. The information handling system 100 may further include a base chassis including an outer cover surface that houses a blower and/or a housing for a blower. In an embodiment, the blower may include a shaft, a hub operatively coupled to the shaft, an inner axial blower blade set operatively coupled to the hub, and an outer centrifugal blower blade set operatively coupled to the hub. In some embodiments, the outer blade set forms a monolithic piece with the inner axial blower blade set. In other embodiments, the inner axial blade set may be separately formed and operatively coupled to the outer centrifugal blade set and hub of the blower system. In the embodiments described herein, the inner axial blower blade set may increase the redirection of the airflow to the outer centrifugal blower blade set.

The incorporation of the inner axial fan blade set with the outer centrifugal fan blade set allows for an incoming airflow that is parallel with the axis of the blower to be quickly directed away from the hub in a radial direction generally perpendicular to the mechanical axis of the blower. In an embodiment, the incoming airflow is directed into this radial direction relatively more quickly and efficiently than would a blower including only a simple set of centrifugal fan blades could accomplish. The angle of attack of a leading edge of the inner axial fan blades of the inner axial fan blade set may be selected to optimize the redirection of airflow from the incoming airflow direction parallel to the axis to the outer centrifugal blower blade set selected to optimize the airflow in a radial direction away from the axis. Other geometric features may be included with each of the inner axial fan blades such as a curved edge of a distal end of each of the inner axial fan blades.

In some embodiments, the hub, inner axial fan blade set, and/or outer centrifugal fan blade set may form a single, monolithic piece. In a specific example embodiment, the inner axial fan blade set, the outer centrifugal fan blade set, and the hub may be formed into a single, monolithic piece using a sandcasting manufacturing method for a plastic material or the like. In this specific embodiment, the geometric characteristics of the blades of the inner axial fan blade set and outer centrifugal fan blade set may be formed during this sandcasting process. Although specific types of manufacturing processes are described herein, the present specification also contemplates that any other type of manufacturing processes may be used to form the hub, inner axial fan blade set, and outer centrifugal fan blade set (either together or separately) including, but not limited to, any additive manufacturing process, any subtractive manufacturing process, any casting process, any injection molding process, any 3-D printing process, or similar process.

In another example embodiment, the outer centrifugal fan blade set and the hub may be a single monolithic piece with the inner axial fan blade set being mechanically coupled to a portion of the hub during assembly. In this embodiment, the monolithic piece of the outer centrifugal fan blade set and hub, as well as the inner axial fan blade set, may each be manufactured using an injection molding process. The outer centrifugal fan blade set may be formed to include a well into which the inner axial fan blade set may sit thereby placing the inner axial fan blade set between the outer centrifugal fan blade set and the hub as described herein.

The blower described herein may be placed within a housing of an information handling system. In a specific embodiment, the blower and housing may be placed within a base portion of an information handling system, such as a notebook-type information handling system where a processor or other heat generating devices are located. In a specific embodiment, the blower may include its own housing that is secured to a chassis of the information handling system. This housing may include a top blower housing and a bottom blower housing. In this embodiment, the top blower housing may include an air inlet through which air is pulled into the blower. Additionally, the housing of the blower may include one or more air outlets through which air is passed out of the blower via operation of the blower. In a specific embodiment, the blower may include a first and a second air outlet that cause the airflow to exit the housing of the blower at, generally, opposite directions to increase the amount of airflow out of the blower housing and to the elements of the information handling system to be cooled. In an embodiment, the housing of the blower may further include a number of walls. In an embodiment, the walls may include a notch that extends a portion of the wall into the housing and along an exterior perimeter of the outer centrifugal fan blade set. The notch may have a curvilinear shape that increases the air pressure of the air and thereby increases the airflow through the blower to one or more air outlets.

FIG. 1 illustrates an information handling system 100 similar to information handling systems according to several aspects of the present disclosure. In the embodiments described herein, an information handling system 100 includes any instrumentality or aggregate of instrumentalities operable to compute, classify, process, transmit, receive, retrieve, originate, switch, store, display, manifest, detect, record, reproduce, handle, or use any form of information, intelligence, or data for business, scientific, control, entertainment, or other purposes. For example, an information handling system 100 can be a personal computer, mobile device (e.g., personal digital assistant (PDA) or smart phone), server (e.g., blade server or rack server), a consumer electronic device, a network server or storage device, a network router, switch, or bridge, wireless router, or other network communication device, a network connected device (cellular telephone, tablet device, etc.), IoT computing device, wearable computing device, a set-top box (STB), a mobile information handling system 100, a palmtop computer, a laptop or notebook type computer, a desktop computer, a communications device, an access point (AP), a base station transceiver, a wireless telephone, a land-line telephone, a control system, a camera, a scanner, a facsimile machine, a printer, a pager, a personal trusted device, a web appliance, or any other suitable machine capable of executing a set of instructions (sequential or otherwise) that specify actions to be taken by that machine, and can vary in size, shape, performance, price, and functionality.

In specific embodiments herein, the information handling system 100 is described herein as being a notebook-type, or laptop computing device, however the blower system of the present embodiments may be used with nay information handling system. These types of information handling systems 100 may include a series of chassis (e.g., a metal chassis) used to encase the components of the information handling system 100 such as for a display screen in a laptop type information handling system. For example, the chassis may include an A-cover functioning to enclose a portion of the information handling system 100. In this embodiment, the chassis may further include a B-cover functioning to enclose the video or digital display device. Here, the A-cover and the B-cover may be joined together in an embodiment to form a fully enclosed display chassis of the laptop-type information handling system 100. In this embodiment, the chassis may further include a D-cover housing a processor, memory, power management unit (PMU), thermal cooling system, and blower system, keyboard, touchpad, touchscreen, and any chassis or board in which these components are set into the chassis. The chassis may also include a C-cover to enclose the base housing for the laptop-type information handling system 100. In some embodiments, the C-cover and D-cover may operate to enclose or house a second display screen or support a large foldable display screen with the display system having a second display screen or a supported, large foldable display screen with the display housing and base housing. These systems may be a dual-screen or foldable screen notebook-type information handling system 100 in some embodiments. In any of these embodiments, the C-cover and the D-cover may be joined together to form a fully enclosed base chassis. The display chassis and base chassis, in some embodiments described herein, may be coupled together via a hinge operably connecting the display chassis (e.g., the A-cover and B-cover assembly) with the base chassis (e.g., C-cover and the D-cover assembly) so as to place the base chassis of the laptop-type or notebook-type information handling system 100 in a plurality of configurations with respect to the digital display enclosed within the display chassis.

Because of the transportability of these laptop-type information handling systems 100, the weight and certain dimensions of these information handling systems 100 are to be reduced to make handling easier by the user. The weight of size of the information handling system 100 may be reduced by making the display chassis and, more specifically, the base chassis thinner. The base chassis may be a location within the information handling system 100 where the blower is placed. However, by making the base chassis thinner, the ability of a blower to cool and maintain temperatures within the base chassis is reduced due to the reduced size of the blower that can be placed within the thinner base chassis. Indeed, the ability of the blower to pass a sufficient amount of air efficiently throughout the base chassis with a thinner dimension of the blower may help to reduce the physical footprint of the blower thereby reducing the dimensions of the base chassis and the information handling system 100 as well. The present specification describes such a blower with relatively more efficient airflow output and a thinner dimension than a conventional blower. As described herein, the combination of an inner axial blower blade set 132 and an outer centrifugal blower blade set 134 causes the incoming airflow into the blower system to be redirected and passed quicker or more efficiently out of one or more air outlets of the blower. The features of the inner axial blower blade set 132 and outer centrifugal blower blade set 134 will be described in more detail herein.

In a networked deployment, the information handling system 100 may operate in the capacity of a server or as a client computer in a server-client network environment, or as a peer computer system in a peer-to-peer (or distributed) network environment. In a particular embodiment, the information handling system 100 can be implemented using electronic devices that provide voice, video or data communication. For example, an information handling system 100 may be any mobile or other computing device capable of executing a set of instructions (sequential or otherwise) that specify actions to be taken by that machine. Further, while a single information handling system 100 is illustrated, the term "system" shall also be taken to include any collection of systems or sub-systems that individually or jointly execute a set, or multiple sets, of instructions to perform one or more computer functions.

The information handling system 100 can include memory (volatile (e.g. random-access memory, etc.), nonvolatile (read-only memory, flash memory etc.) or any combination thereof), one or more processing resources, such as a central processing unit (CPU), a graphics processing unit (GPU), as the processor 102, hardware or software control logic, or any combination thereof. Additional components of the information handling system 100 can include one or more storage devices, one or more communications ports for communicating with external devices, as well as, various input and output (I/O) devices, such as a keyboard 114, a mouse 116, a video/graphic display 110, or any combination thereof. The information handling system 100 can also include one or more buses 108 operable to transmit communications between the various hardware components. Portions of an information handling system 100 may themselves be considered information handling systems 100.

Information handling system 100 can include devices or modules that embody one or more of the devices or execute instructions for the one or more systems and modules described herein, and operates to perform one or more of the methods described herein. The information handling system 100 may execute code instructions 124 that may operate on servers or systems, remote data centers, or on-box in individual client information handling systems 100 according to various embodiments herein. In some embodiments, it is understood any or all portions of code instructions 124 may operate on a plurality of information handling systems 100.

The information handling system 100 may include a processor 102 such as a central processing unit (CPU), control logic or some combination of the same. Any of the processing resources may operate to execute code that is either firmware or software code. Moreover, the information handling system 100 can include memory such as main memory 104, static memory 106, computer readable medium 122 storing instructions 124 associated with the main memory 104, static memory 106 and processor 102, and drive unit 116 (volatile (e.g. random-access memory, etc.), nonvolatile (read-only memory, flash memory etc.) or any combination thereof). The information handling system 100 can also include one or more buses 108 operable to transmit communications between these various hardware components such as any combination of various input and output (I/O) device 112, such as the video/graphic display 110, the keyboard 114, or the mouse 116.

The information handling system 100 may further include a video/graphic display 110. The video/graphic display 110 in an embodiment may function as a liquid crystal display (LCD), an organic light emitting diode (OLED), a flat panel display, or a solid-state display. Additionally, the information handling system 100 may include an input device 112, such as a cursor control device (e.g., mouse 116, touchpad, or gesture or touch screen input, and a keyboard 114) to direct a cursor across a graphic display on the video/graphic display 110. The information handling system 100 can also include a disk drive unit 118. The drive unit 118 may receive a portable computer readable medium 122 that includes space to store instructions, parameters, and profiles 124 similar to the space provided on the other memory devices described herein.

The network interface device 120 may provide connectivity to a network 126, e.g., a wide area network (WAN), a local area network (LAN), wireless local area network (WLAN), a wireless personal area network (WPAN), a wireless wide area network (WWAN), or other networks. Connectivity may be via wired or wireless connection. The network interface device 120 may operate in accordance with any wireless data communication standards. To communicate with a wireless local area network, standards including IEEE 802.11 WLAN standards, IEEE 802.15 WPAN standards, WWAN such as 3GPP or 3GPP2, or similar wireless standards may be used. In some aspects of the present disclosure, one network interface device 120 may operate two or more wireless links. The network interface device 120 may connect to any combination of macro-cellular wireless connections including 2G, 2.5G, 3G, 4G, 5G or the like from one or more service providers. Utilization of radiofrequency communication bands according to several example embodiments of the present disclosure may include bands used with the WLAN standards and WWAN standards, which may operate in both licensed and unlicensed spectrums.

In some embodiments, software, firmware, dedicated hardware implementations such as application specific integrated circuits, programmable logic arrays and other hardware devices can be constructed to implement one or more of some systems and methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by firmware or software programs executable by a controller or a processor system. Further, in an exemplary, non-limited embodiment, implementations can include distributed processing, component/object distributed processing, and parallel processing. Alternatively, virtual computer system processing can be constructed to implement one or more of the methods or functionalities as described herein.

The present disclosure contemplates a computer-readable medium that includes instructions, parameters, and profiles 124 or receives and executes instructions, parameters, and profiles 124 responsive to a propagated signal, so that a device connected to a network 126 can communicate voice, video or data over the network 126. Further, the instructions 124 may be transmitted or received over the network 126 via the network interface device 120 or other types of wireless adapters.

The information handling system 100 can include a set of instructions 124 that can be executed to cause the computer system to perform any one or more of the methods or computer-based functions disclosed herein. For example, instructions 124 may execute software agents, or other aspects or components. Various software modules comprising application instructions 124 may be coordinated by an operating system (OS), and/or via an application programming interface (API). An example operating system may include Windows®, Android®, and other OS types. Example APIs may include Win 32, Core Java API, or Android APIs.

The disk drive unit 116 may include a computer-readable medium 122 in which one or more sets of instructions 124 such as software can be embedded. Similarly, main memory 104 and static memory 106 or other memory may also contain a computer-readable medium for storage of one or more sets of instructions, parameters, or profiles 124 including instructions, parameters, and profiles 124 related to operating a thermal cooling system 148 with blower controller 136 for controlling a blower motor 138 by the operation of a blower controller 136. The disk drive unit 116 and static memory 106 may also contain space for data storage. Further, the instructions 124 may embody one or more of the methods or logic as described herein. For example, instructions executed by the blower controller 136 software algorithms, processes, and/or methods may be stored here. In a particular embodiment, the instructions, parameters, and profiles 124 may reside completely, or at least partially, within the main memory 104, the static memory 106, and/or within the disk drive 116 during execution by the processor 102 of information handling system 100. As explained, some or all of the instructions executed by the blower controller 136 may be executed locally or remotely. The main memory 104 and the processor 102 also may include computer-readable media.

Main memory 104 may contain computer-readable medium (not shown), such as RAM in an example embodiment. An example of main memory 104 includes random access memory (RAM) such as static RAM (SRAM), dynamic RAM (DRAM), non-volatile RAM (NV-RAM), or the like, read only memory (ROM), another type of memory, or a combination thereof. Static memory 106 may contain computer-readable medium (not shown), such as NOR or NAND flash memory in some example embodiments. Any computer executable program code may be stored in static memory 106, or the drive unit 116 on a computer-readable medium 122 such as a flash memory or magnetic disk in an example embodiment. While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random-access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

The information handling system 100 may further include a power management unit (PMU) 152. The PMU 142 may manage the power provided to the components of the information handling system 100 such as the processor 102, memory, network interface device (NID) 120, the blower controller 136, the blower motor 138, and the video/graphic display 110. In an embodiment, the PMU 142 may be electrically coupled to a printed circuit board associated with the blower system 128 to provide power to, for example, the blower motor 138 operatively coupled to the blower controller 136 and blower system 128. The PMU 142 may also be coupled to the bus 108 of the information handling system 100 to provide data communication regarding management of power. The PMU 142 may manage power connections to the various components via power rails or cabling of the information handling system 100 as described herein. In an embodiment, the amount of power provided to the blower controller 136 and blower motor 138 for the blower system 128 to operate may be sufficient to rotate the inner axial blower blade set 132 and outer centrifugal blower blade set 134 as described herein. The PMU 142 may include regulating power from a power source such as a battery 144 or an A/C power sources 146 with transformers and the like. In an embodiment, the battery 144 may be charged via the A/C power source 146 and provide power the to the components of the information handling system 100 when A/C power 146 is removed.

As described, the information handling system 100 may include a blower controller 136 that may be operably connected to the bus 108. The blower controller 136 may include processing logic and may be coupled to the PMU 142 for drawing power to the blower motor 138 associated with the blower system 128. The computer readable medium 122 associated with the blower controller 136 may also contain space for data storage. In some embodiments, the blower controller 136 may, upon execution of the processor 102, cause signals to be sent to the blower motor 138 and/or a printed circuit board (PCB) associated with the blower motor 138 to operate the blower system 128 when certain circumstances are met. By way of example, the blower controller 136 may cause the blower system 128 and specifically the shaft 140 of the blower system 128 (operatively coupling the blower motor 138 to the central hub 130, inner axial blower blade set 132, and outer centrifugal blower blade set 134) to turn when the processor 102 has received a signal of a thermal cooling system 148 descriptive of a high temperature within the information handling system 100. The temperature may be detected via, for example, a temperature sensor 158 within the information handling system 100. In another embodiment, the blower controller 136 may send the signals to the blower motor 138 to operate based on a threshold number of processes being executed by the processor 102. Because the blower system 128 is meant to cool down certain elements within the information handling system 100 and specifically the processor or processors 102 (e.g., CPU or GPU) or the power systems under PMU 142, the number of processes executed by the processor 102 may be indicative of an anticipated rise in temperature within the information handling system 100. Other methods may be implemented by the processor 102, thermal cooling system 148, and blower controller 136 to direct the operation of the blower system 128 and the present specification contemplates the use of these other methods.

In an embodiment, the blower system 128 may be associated with other cooling devices that may be included within the information handling system 100. In an embodiment the information handling system 100 may include additional cooling systems such as heat pipes 150, heat sinks 152, vapor chambers 154, liquid cooling systems 156, as well as other specific types of passive or active cooling components as part of the thermal cooling system 148. In the example where heat sinks 152, heat pipes 150, and vapor chambers 154 are used, the blower system 128 may be used and situated within the information handling system 100 so as to create an airflow through the base chassis to these additional cooling devices. The passage of the airflow over the heat pipes 150, heat sinks 152, and vapor chambers 154 directs heat away from the components of the information handling system 100. In an embodiment, the base chassis may include various airflow passages from the blower system 128, past the heat pipes 150, heat sinks 152, and vapor chambers 154, and out of the base chassis. Heated air may also leave the chassis of the information handling system 100 via exhaust vents situated on the sides, back, C-cover, D-cover, or anywhere in the chassis or information handling system housing.

In an embodiment, the thermal cooling system 148 may have control along with the blower controller 136 that may communicate with one or more blower devices, the main memory 104, the processor 102, the video/graphic display 110, the alpha-numeric input device 112, and the network interface device 120 via bus 108, and several forms of communication may be used, including ACPI, SMBus, a 24 MHZ BFSK-coded transmission channel, or shared memory. Driver software, firmware, controllers and the like may communicate with applications on the information handling system 100.

In other embodiments, dedicated hardware implementations such as application specific integrated circuits, programmable logic arrays and other hardware devices can be constructed to implement one or more of the systems or methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

The present specification describes a blower system 128 that may include any or all of a central hub 130, an inner axial blower blade set 132, an outer centrifugal blower blade set 134, a shaft, 140, a blower housing, and a blower motor 138, among other devices. The blower system 128 is formed to be capable of rapidly redirecting air entering the blower system 128 and passing it out of one or more air outlets formed in a housing of the blower system 128. This is done by including an inner axial blower blade set 132 between the central hub 130 of the blower system 128 and an outer centrifugal blower blade set 134 with blades having a different pitch, shape, or orientation from the inner axial blower blade set 132. The inner axial blower blade set 132 may include a plurality of axial blower blades that are in the form of an impeller of a first pitch or contour to drawn air into the blower system 128 and redirect the air relatively quicker to the centrifugal blower blades forming the outer centrifugal blower blade set 134 having a second pitch or blower for radial dispersion of the airflow to one or more air outlets. The present specification contemplates that the inner axial blower blade set 132 may include any number of axial blower blades and the outer centrifugal blower blade set 134 may include any number of centrifugal blower blades. In a specific embodiment, the outer centrifugal blower blade set 134 may 70 vertical centrifugal blower blades formed radially from the axis of the central hub 130 or from the radial end of the inner axial blower blade set 132.

In conventional blowers, a set of outer centrifugal blades are operatively coupled to the central hub such that air entering the blower must flow inward generally parallel to a rotational axis of the blower and is drawn in by the impeller blades and forced or thrown out of the blower and its housing via the impeller blades where much of the airflow reaches a bottom portion of the blower before exiting an air outlet. As a consequence, in the area near the central hub of the blower, the centrifugal forces placed on the air are more perpendicular to the incoming airflow direction such that the centrifugal force produced by the centrifugal blades is not accelerating the airflow radially to the air outlets efficiently. This renders the lower portions of the centrifugal blades less effective in pushing air out of the blower and throughout the information handling system 100.

The axial blower blades of the inner axial blower blade set 132 described herein turns the air entering the blower at a quicker angle as it enters the blower system 128 to a direction parallel to the axis of the central hub 130 thereby preventing the air from accumulating at a lower end of the blades of the blower system 128. The axial blower blades of the inner axial blower blade set 132 may rapidly direct the airflow of air entering the blower system 128 due to the air pressure created by the rotation and due to the pitch or contour characteristics of those axial blower blades. The increased redirection of air causes a relatively stronger airflow to be created by the axial blower blades as the air enters and then exits the blower system 128. The axial blower blades of the inner axial blower blade set 132 redirect an increased airflow more efficiently to the outer centrifugal blower blade set 134 for those blades to push the air out of the blower system 128.

To facilitate the most rapid redirection of the airflow through the blower system 128 by the axial blower blades of the inner axial blower blade set 132, the axial blower blades may have an angle of attack that creates such an increased air pressure and resulting airflow redirection. In an embodiment, a leading edge of each of the axial blower blades (also called vanes) may be set to be rotationally forward of a trailing edge. In the present specification and in the appended claims, the term "leading edge" of a blade of the inner axial blade set 132 is meant to be understood as the foremost edge of a blade that comes in contact with air as it enters the blower system 128 via an inlet. Similarly, in the present specification and in the appended claims, the term "trailing edge" of a blade in the inner axial blade set 132 is meant to be understood as the rearmost or lower most edge of that blade.

In some embodiments, the inner axial blower blades of the inner axial blower blade set 132 may be formed into an airfoil such that certain portions of the blade are curvilinear shaped or thicker at some locations than other portions. In this embodiment, the curved surfaces may be designed to produce the most air pressure at the inner axial blower blades of the inner axial blower blade set 132 as well as optimize the redirection of that air towards the centrifugal blower blades of the outer centrifugal blower blade set 134. In an embodiment, a cross-section of any given axial blower blade at one location along a length of that blade may be different than a cross-section of that blade at another location.

Each of the axial blower blades of the inner axial blower blade set 132 may be operatively coupled, at a proximal end, to the central hub 130 of the blower system 128. In a specific embodiment, a leading edge of a proximal end of the inner axial blower blades may be flush or nearly flush with a top of the central hub 130. In an embodiment, a trailing edge of the proximal end of the axial blower blades may be flush or nearly flush with a bottom of the central hub 130 such as in an embodiment of an outer centrifugal blower blade set 134 and hub monolithic blade construction. Again, the leading edge of a proximal end of the axial blower blades of the inner axial blower blade set 132 may be at a position, radially, different than the trailing edge of the proximal end of the axial blower blades such that the axial blower blades are non-vertical relative, radially, to the axis of the central hub 130 or where the frontal plane and the longitudinal plane intersect.

In an embodiment, a distal end of each of the axial blower blades of the inner axial blower blade set 132 may interface with a proximal end of the centrifugal blower blades of the outer centrifugal blower blade set 134. This interfacing of the distal end of the axial blower blades and proximal end of the centrifugal blower blades may include a physical coupling of these two types of blades in an embodiment of the inner axial blower blade set 132 and the outer centrifugal blower blade set 134 as two separable but couplable structures. In another embodiment, described herein, the inner axial blower blade set 132, outer centrifugal blower blade set 134, and central hub 130 may be a single, monolithic piece. As such, multiple centrifugal blower blades may be formed to the edge or edges of one or more of the axial blower blades because the vertical orientation of the centrifugal blower blades causes them to, in some instances, be formed to a plurality of non-vertical axial blower blades. In a specific embodiment, the monolithic piece that includes the inner axial blower blade set 132, the outer centrifugal blower blade set 134, and the central hub 130 may be created using a sandcasting manufacturing process. Other types of manufacturing processes may be used to form this monolithic piece such as, but not limited to, any additive manufacturing process, any subtractive manufacturing process, any casting process, or any injection molding process. The design of the axial blower blades will be described in more detail herein with reference to FIGS. 2-13

In yet another embodiment, the interface between a distal end of the axial blower blades and the proximal end of the centrifugal blower blades may be coupled along these ends by two processes for an inner axial blower blade set 132 being fitted with an outer centrifugal blower blade set 134. In this embodiment, a proximal end of the centrifugal blower blades may be operatively and physically coupled or formed as part of the central hub 130 at a lower portion of the central hub 130. A portion of the centrifugal blower blades may be cut away forming a well or cavity to allow a separate piece of the blower system 128 that includes the axial blower blades of the inner axial blower blade set 132 to be inserted or fitted into the well. In this embodiment, the inner axial blower blade set 132 may include an inner axial blower blade set ring to which a proximal end of the axial blower blades of the inner axial blower blade set 132 formed or coupled to. The inner axial blower blade set ring may be operatively coupled to the central hub 130 in order to fix the inner axial blower blade set 132 in place relatively to the inner axial blower blade set 132 and the outer centrifugal blower blade set 134. The inner axial blower blade set 132 and its inner axial blower blade set ring may be operatively coupled to the central hub 130 using, for example, a screw, a nail, glue, a spline, a compression fit, or any type of device or method that causes the inner axial blower blade set 132 to rotate with the rotation of the central hub 130. Each of the inner axial blower blade set 132 piece and outer centrifugal blower blade set 134 central hub 130 piece may be manufactured using any type of additive manufacturing process, subtractive manufacturing process, casting process, 3-D printing process, or injection molding process as is appropriate.

As described herein, the centrifugal blower blades of the outer centrifugal blower blade set 134 may be vertical or nearly vertical relative to the radial plane. That is, each of the centrifugal blower blades may radiate away from an axis of the central hub 130 and may be vertical and radially parallel relative to a rotation axis of the central hub 130. Again, in some embodiments, any one of the centrifugal blower blades may interface one or more axial blower blades due to the skewed nature of the axial blower blades relative to the vertical centrifugal blower blades. This interface will be described in more detail herein with reference to FIGS. 2-13.

As briefly described herein, the blower system 128 may include a central hub 130 that is operatively coupled to a shaft 140 and a blower motor 138. The shaft may serve as a mechanical axis of the central hub 130, inner axial blower blade set 132 and outer centrifugal blower blade set 134 in order to operate the blower system 128 as described herein. The shaft 140 mechanically couples the blower system 128 to the blower motor 138 to receive a rotative force in order to rotate the blades herein.

When referred to as a "system", a "device," a "module," a "controller," or the like, the embodiments described herein can be configured as hardware. For example, a portion of an information handling system device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card International Association (PCMCIA) card, or other such expansion card), or a system (such as a motherboard, a system-on-a-chip (SoC), or a standalone device). The system, device, controller, or module can include software, including firmware embedded at a device, such as an Intel® Core class processor, ARM® brand processors, Qualcomm® Snapdragon processors, or other processors and chipsets, or other such device, or software capable of operating a relevant environment of the information handling system. The system, device, controller, or module can also include a combination of the foregoing examples of hardware or software. In an embodiment an information handling system 100 may include an integrated circuit or a board-level product having portions thereof that can also be any combination of hardware and software. Devices, modules, resources, controllers, or programs that are in communication with one another need not be in continuous communication with each other, unless expressly specified otherwise. In addition, devices, modules, resources, controllers, or programs that are in communication with one another can communicate directly or indirectly through one or more intermediaries.

Figure 2:
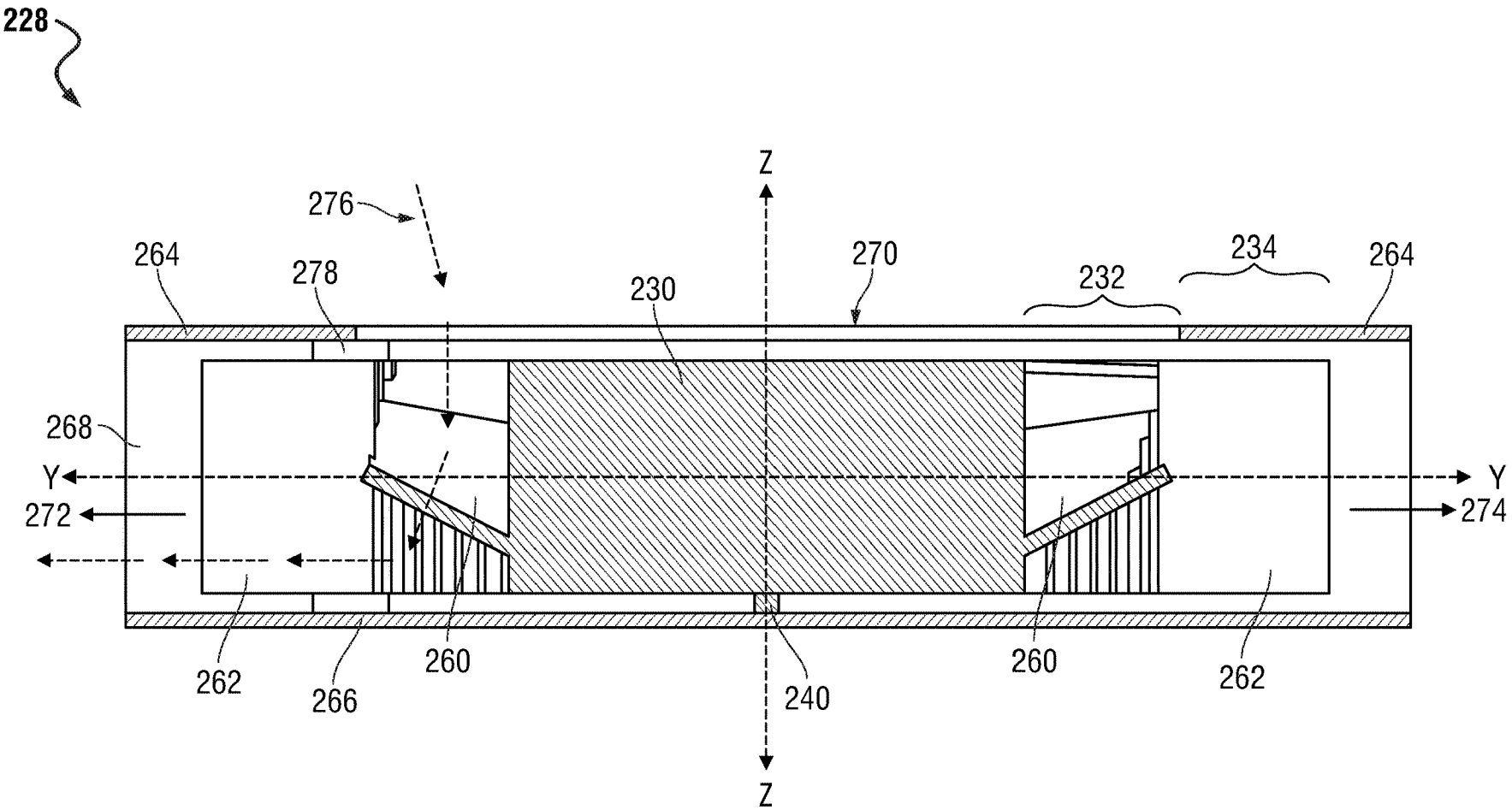
FIG. 2 is a graphical illustration of a side, cut-away view of a blower system according to an embodiment of the present disclosure.

FIG. 2 is a graphical illustration of a side, cut-away view of a blower 228 according to an embodiment of the present disclosure. The blower 228 described in FIG. 2 shows a housing used to house a shaft 240, the central hub 230, the inner axial blower blade set 232, and the outer centrifugal blower blade set 234. This housing is depicted as being separate from any chassis housing or support structures within the information handling system. The present specification contemplates that instead of including a separate housing for the blower 228, any housing structures may be formed within or as part of the base chassis housing parts (e.g., a C-cover or D-cover or other chassis support structures). Additionally, the blower 228 described in connection with FIG. 2 may impart certain designs, lengths, widths, or characteristics of the components of the blower 228. However, it is appreciated that these are provided as example embodiments and are not intended as a limitation on the ability of the blower 228 to increase the airflow into and out of the blower 228.

In an embodiment, the housing may include a top blower housing wall 264. The top blower housing wall 264, in an embodiment, may form part of a C-cover of an information handling system or may be, in another embodiment, a distinct part for the blower 228. As shown, the top blower housing wall 264 may include an air inlet 270. The air inlet 270 may provide a fluidic path through which an amount of air may be drawn into the blower 228 through rotational operation of the inner axial blower blade set 232 and outer centrifugal blower blade set 234. In an embodiment, the air inlet 270 may be in the form of a circular cutout in the top blower housing wall 264 and may have a specific radius. In an embodiment, the radius of the air inlet 270 may be about equal to a length of the axial blower blades 260 of the inner axial blower blade set 232. In other embodiments, the radius of the air inlet 270 may be greater or less than a length of the axial blower blades 260 of the inner axial blower blade set 232.

In an embodiment, the housing of the blower 228 may include a bottom blower housing wall 266. The bottom blower housing wall 266, in a specific embodiment, may form part of a D-cover of a base portion of an information handling system as described herein. In another embodiment, the bottom blower housing wall 266 may be a distinct housing portion apart from any part of a housing or chassis of an information handling system. In an embodiment, the bottom blower housing wall 266 may include a hole through which a shaft 240 may be passed. The shaft 240 may be coupled to a central hub 230 within the blower 228 to impart a rotational force against the central hub 230 in order to operate the blower 228. The shaft 240 may further be coupled to a blower motor (e.g., blower motor 138, FIG. 1) to transfer the rotational force from that blower motor to the central hub 230.

The housing of the blower 228 may further include one or more blower housing side walls 268 in an embodiment. In some embodiments, any of the blower housing side walls 268 may be part of the C-cover or D-cover of the base portion of an information handling system. The blower housing side walls 268 may define a volume within the blower 228 that the pressure of the air within the blower 228 may be increased due to the operation of the inner axial blower blade set 232 as described herein. In some embodiments, one or more of the blower housing side walls 268 may include a notch 278 that conforms a portion of the blower housing side walls 268 to an exterior perimeter of the outer centrifugal blower blade set 234. In an embodiment, as the centrifugal blower blades 262 pass the notch 278 at the blower housing side wall 268, the blower 228 may further increase air pressure within its housing. A space inside the housing opposite of notch 278 allows for air flow volume to increase such that air may be moved to one or more of the first air outlet 272 or second air outlet 274. In the shown blower 228 of FIG. 2, the air inlet 270 draws air in, is compressed by the inner axial blower blade set 232 of the blower 228 via spinning the axial blower blades 260 in the clockwise direction with the assistance of the notch 278. In some specific embodiments, the inner axial blower blade set 232 may rotate at 5000 rpm. The increased air pressure and efficient redirection of airflows created by the rotation of the inner axial blower blade set 232 as well as the increase in air pressure due to the inclusion of the notch 278, may increase the efficiency of the airflow into and out of the blower 228 thereby increasing the ability of the blower 228 to cool the components of an information handling system. This may also decrease the power consumption of the blower 228.

In any of the embodiments described herein, the outer dimensions of the blower housing may be any size to accommodate any lengths and heights of the axial blower blades 260 and centrifugal blower blades 262. In a specific embodiment, the outer dimensions of the top blower housing wall 264 may be 62 mm wide, 62 mm long, and 13 mm high to accommodate a blade length (axial blower blade 260 length plus centrifugal blower blade 262 length) of 54 mm and a blade height of 10 mm.

In a specific embodiment, the blower 228 of FIG. 2 and the present disclosure may include two notches, a first notch 278 on a first blower housing side wall 268 and a second notch on a second blower housing side wall 268 arranged opposite the first blower housing side wall 268. These notches 278 may be, in a specific embodiment, a curvilinear shape inside of the blower housing side walls 268 respectively internal to the first air outlet 272 and second air outlet 274 oppositely arranged to each other. The notches 278 curve from the blower housing side walls 268 such that they form a notch angle. The curvilinear shape may increase inward along the blower housing side walls 268 in the direction of rotation (e.g., clockwise as depicted) of the blower 228 at this notch angle. The curvilinear shape of notches 278 may then be formed to recede to follow the shape of the circumference of the centrifugal blower blades 262 of the outer centrifugal blower blade set 234. This notch angle may be anywhere from 30 to 70 degrees depending upon a notch offset which is offset from an axis of rotation of the blower 228 in some optimized embodiments. In other embodiments, 0 degrees to 90 degrees may be used. There may be no notches 278 or the notches 278 may be of a variety of shapes including angled, pointed, squared off at 90 degrees, or the like in various embodiments. The notch angle and notch offset may define the shape and how far the notches 278 extend from the blower housing side wall 268. Further differing shapes of notches 278 may provide less or greater resistance and air pressurization capability for the blower 228 within the housing or may yield additional noise whereby a shape or size of notch 278 may be determined based upon such factors. Other shapes of notches 278 are contemplated including angled notches 278 with pointed extensions or rounded extensions, rounded notches 278, wavy notches 278, or notches 278 of a variety of shapes or contours. In other embodiments, rotation of the centrifugal blower blades 262 and axial blower blades 260 may be counter-clockwise instead of clockwise as shown. Such reversed direction of the rotation of the blower 228 may result in changed placement of notches 278 in some embodiments. As a consequence of the inclusion of the notches 278 and inner axial blower blade set 232, the air pressure is increased within the housing of the blower 228 thereby further increasing the amount of airflow produced by the blower 228 generally.

As described, in an embodiment, the blower 228 may include a first air outlet 272 and a second air outlet 274 that are fluidically coupled to the air inlet 270. The first air outlet 272 and second air outlet 274 may be opposite each other in an embodiment, to allow air to be passed in multiple directions throughout the information handling system. During operation of the blower 228, the central hub 230 may be turned by the shaft 240 and the blower motor as described herein. This causes the inner axial blower blade set 232 and outer centrifugal blower blade set 234 to turn as well. In these embodiments, and airflow 276 is created through the blower 228. In a specific embodiment, the form and angle of attack of the axial blower blades 260 of the inner axial blower blade set 232 cause air to be drawn into the blower 228 at an increased speed. Still further the form and angle of attack of the axial blower blades 260 may be formed to efficiently redirect the airflow 276 down and out towards the centrifugal blower blades 262 of the outer centrifugal blower blade set 234 relatively quicker than had the blower 228 included only centrifugal blower blades 262. The centrifugal blower blades 262 of the outer centrifugal blower blade set 234 are generally vertical and thus efficiently direct airflow 276 radially outward via first and second air outlets 274 and 276, respectively. In these embodiments, the airflow 276 is prevented from accumulating at lower portions of the axial blower blades 260 and centrifugal blower blades 262 causing more efficient transfer of air through the blower 228 and throughout the information handling system. It has been discovered through laboratory experimentation that this blower system that includes the central hub 230 and the inner axial blower blade set 232 and outer centrifugal blower blade set 234 produce 11% more airflow in free air resulting in about 12.0 CFM.

Figure 3:
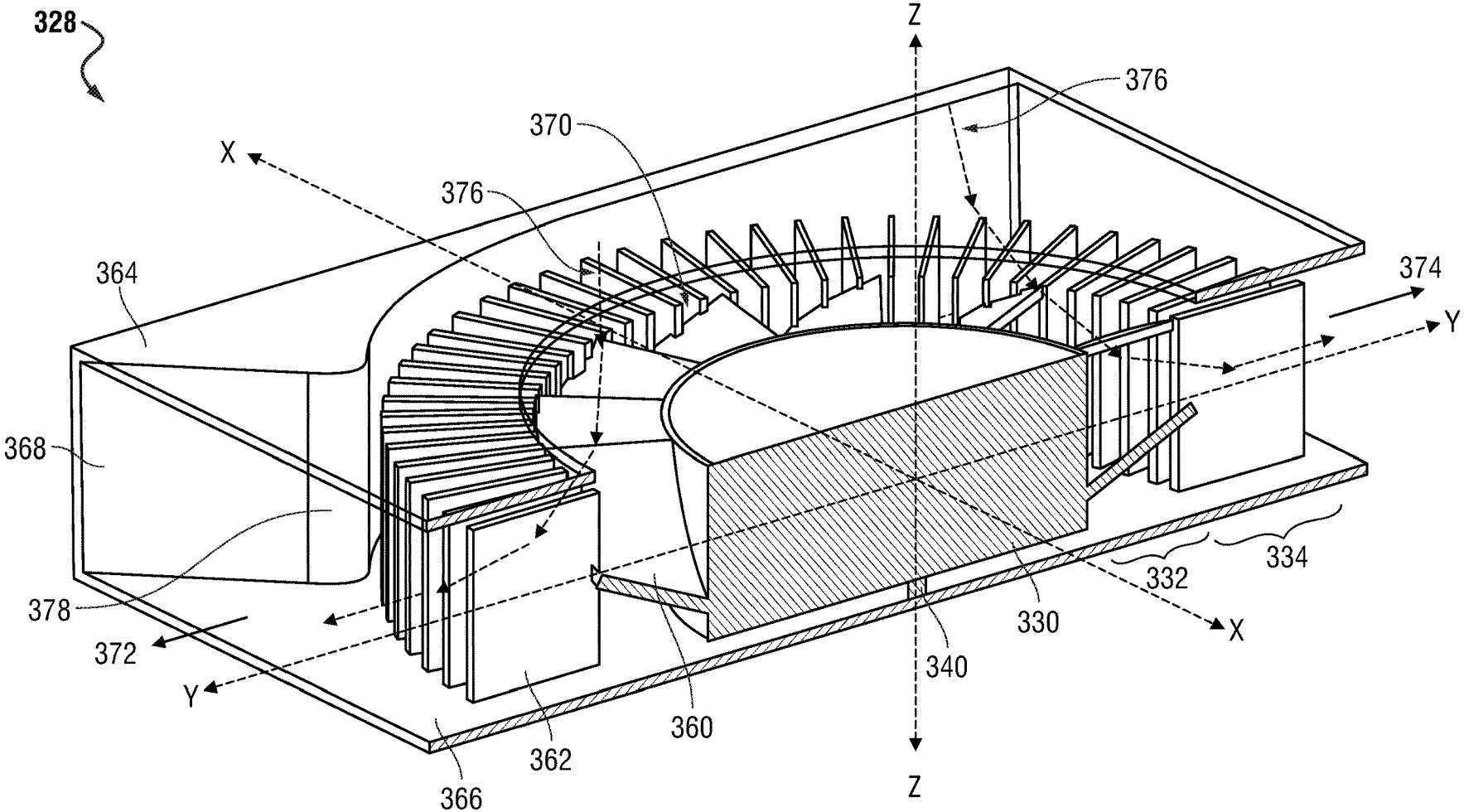
FIG. 3 is a graphical illustration of a perspective, cut-away view of a blower system according to another embodiment of the present disclosure.

FIG. 3 is a graphical illustration of a perspective, cutaway view of a blower 328 according to another embodiment of the present disclosure. FIG. 3 shows more detail of the inner axial blower blade set 332 placed relative to the outer centrifugal blower blade set 334. Additionally, FIG. 3 shows additional detail of the placement of the blower housing side wall 368 and notch 378 relative to an outer diameter of the centrifugal blower blades 362 of the outer centrifugal blower blade set 334.

Again, each of the axial blower blades 360 of the inner axial blower blade set 332 may be operatively coupled to or formed from, at a proximal end, the central hub 330 of the blower 328. In a specific embodiment, a leading edge of a proximal end of the axial blower blades 360 in a direction of rotation may be flush or nearly flush with a top of the central hub 330 with a trailing edge of the proximal end of the axial blower blades 360 flush or nearly flush with a bottom of the central hub 330. Again, the leading edge of a proximal end of the axial blower blades 360 may be at a position, radially, different than the trailing edge of the proximal end of the axial blower blades 360 such that the axial blower blades 360 are non-vertical relative, radially, to the axis of the central hub 330. This slanting of the axial blower blades 360 causes air to be drawn into the blower 328 and redirected towards the centrifugal blower blades 362 efficiently so as to pass an optimal amount of air through the blower 328. The inner axial blower blades 360 may be planar in some embodiment or contoured in other embodiments. Contoured axial blower blades 360 may be of a curvilinear shape to better increase inflow of air from the air inlet 370 and to more efficiently redirect that airflow horizontally and radially to the outer centrifugal blower blade set 334.

In the embodiment shown in FIG. 3 the centrifugal blower blades 362 are formed to outer edges of one or more of the axial blower blades 360. In this specific embodiment, the central hub 330, the inner axial blower blade set 332, and the outer centrifugal blower blade set 334 form a single monolithic piece. As such, the interface between each centrifugal blower blade 362 and one or more of the axial blower blades 360 may include a portion of each of the axial blower blades 360 extending into one or more of the centrifugal blower blades 362 as a structural connection point. As described herein, in an embodiment, a single centrifugal blower blade 362 may be formed to a plurality of axial blower blades 360. In an embodiment, one or more centrifugal blower blades 362 may be physically coupled to one or more axial blower blades 360.

Similar to FIG. 2, the blower 328 includes a top blower housing wall 364 that has an air inlet 370 formed therein. The housing further includes a bottom blower housing wall 366 and one or more blower housing side walls 368 to encase the blower 328 and provide support, through a shaft 340 for the central hub 330, inner axial blower blade set 332, and outer centrifugal blower blade set 334. Additionally, one or more of the blower housing side walls 368 may include a notch 378 formed thereon to conform to an outer perimeter of the centrifugal blower blades 362 in order to create additional air pressures as described herein. These elements create an efficient redirection path for the airflow 376 to pass in to the air inlet 370, through the inner axial blower blade set 332 and outer centrifugal blower blade set 334, and out one or more of the first air outlet 372 and second air outlet 374. The pitch or contour of the axial blower blades 360 is formed to redirect airflow 376 to the centrifugal blower blades 362 of the outer centrifugal blower blade set 334 to be directed radially to the first air outlet 372 and second air outlet 374. The figures described herein show that two air outlets 372, 374 have been formed as apertures by top blower housing wall 364, bottom blower housing wall 366, and two blower housing sidewalls 368 in the blower 328 according to dual, opposite outlet blower embodiments described herein. The present specification also contemplates that a single air outlet 372 or 374 may be formed in other embodiments.

Figure 4:
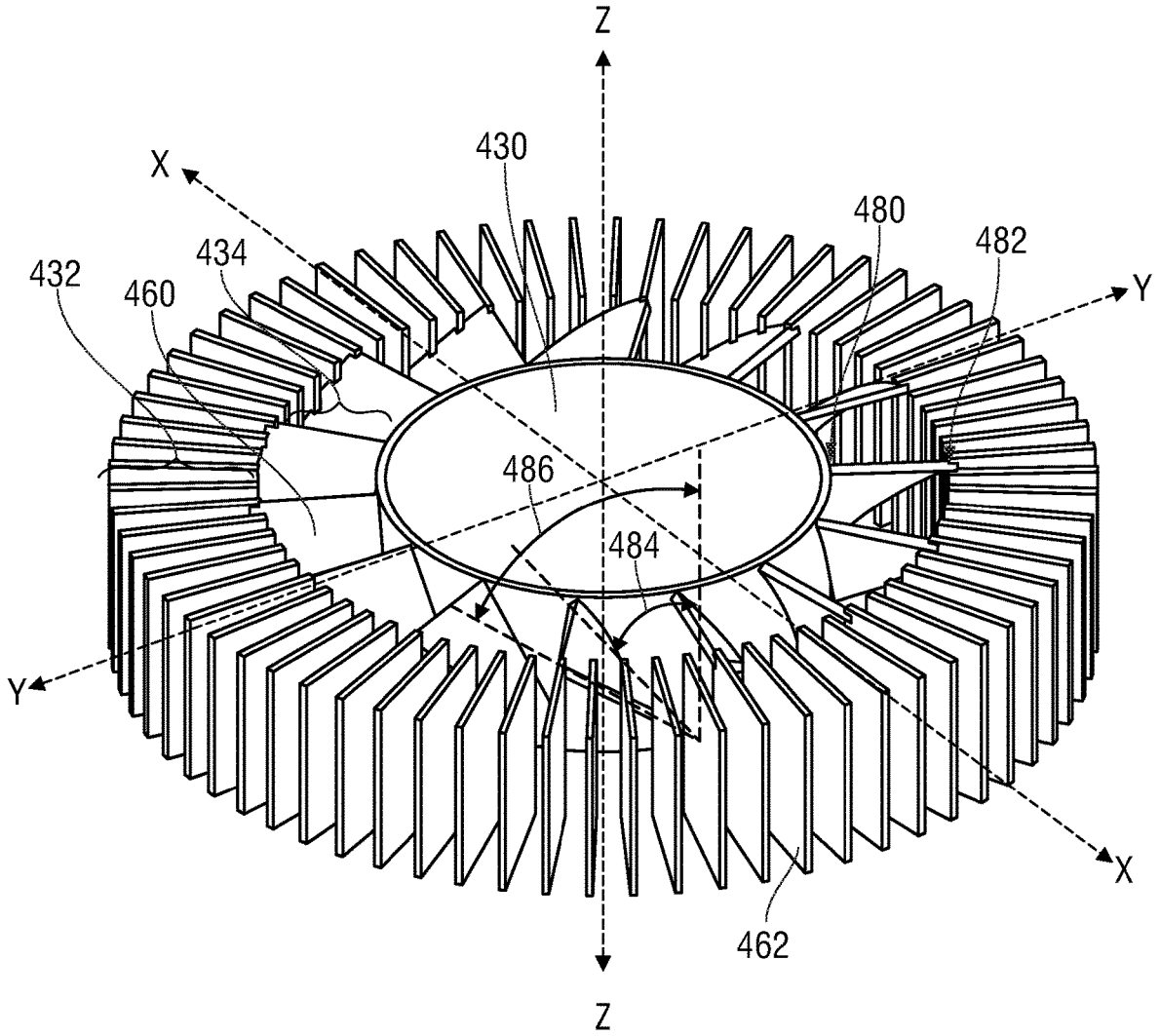
FIG. 4 is a graphical illustration of a perspective view of an inner axial blower blade set and outer centrifugal blower blade set for a blower system according to another embodiment of the present disclosure.

FIG. 4 is a graphical illustration of a perspective view of an inner axial blower blade set 432 and outer centrifugal blower blade set 434 of a blower 428 according to another embodiment of the present disclosure. FIG. 4 shows the blower 428 without a housing around it to show the details of the central hub 430, the pitch or contour of the inner axial blower blade set 432, and the orientation of the outer centrifugal blower blade set 434.

FIG. 4 shows, like other figures herein, the individual axial blower blades 460 interfacing with the centrifugal blower blades 462. In this specific embodiment, the central hub 430, inner axial blower blade set 432, and outer centrifugal blower blade set 434 form a single, monolithic piece with each of the axial blower blades 460 and centrifugal blower blades 462 being physically coupled to one or more of the centrifugal blower blades 462 and axial blower blades 460, respectively.

As described herein, the axial blower blades 460 may be non-vertical. In this embodiment, a leading edge in a direction of rotation of the proximal end of axial blower blade 480 may be coupled to the surface of the central hub 430 at a radial location different from the trailing edge of the proximal end of axial blower blade 480. This creates an airfoil with the axial blower blades 460 such that air is drawn into the blower 428.

In an embodiment, a leading edge of a distal end of the axial blower blade 482 may be located at a position radially similar to the leading edge of the proximal end of axial blower blade 480 due to a curvilinear or contoured shape. In another embodiment, a leading edge of the distal end of the axial blower blade 482 may be located at a position radially dissimilar to the leading edge of the proximal end of axial blower blade 480. In this specific embodiment, the axial blower blade 460 may twist along its length the further the axial blower blade 460 extends out from the central hub 430. In an embodiment, the axial blower blade 482 may be curved. In this embodiment, the curve of the axial blower blade 460 may be of any camber of any degree.

FIG. 4 also shows a number of angles 484 and 486 describing a pitch of an axial blower blade 460 according to an embodiment herein. A first angle 484 indicates a degree of slant of a proximal end of axial blower blade 480 relative to vertical. A second angle 486 indicates a degree of slant of a distal end of the axial blower blade 460 relative to vertical. In this specific embodiment, any difference between the first angle 484 and second angle 486 may indicate a twisting of the axial blower blade 460 from the proximal end of axial blower blade 480 and the distal end of axial blower blade 482. This twisting may further cause additional air pressure to be created as well as producing redirecting force on the airflow thereby causing efficient airflow through and out of the blower 428. In the embodiment shown in FIG. 4, the twisting of the axial blower blades 460 causes the distal end of axial blower blade 482 to almost come horizontal. As such, each of the axial blower blades 460 may be formed at the edges of to a plurality of centrifugal blower blades 462 thereby increasing the structural integrity of the connection points of the axial blower blades 460 and centrifugal blower blades 462. In an embodiment, the axial blower blades 460 may include an airfoil shape similar to that of a wing so as to alter the amount of air drawn into the blower 428.

Although FIGS. 2-13 show specific physical characteristics related to the axial blower blades 460 (e.g., curved, twisted, slanted, etc.), the present specification contemplates that these specific characteristics may be altered in order to optimize the airflow through and out of the blower 428. In an embodiment, these specific characteristics may be modified to optimize the redirection of airflow and air pressure created by the axial blower blades 460 within the blower 428 so that airflow is efficiently increased. As these specific characteristics are optimized to optimize the amount of airflow out of the blower 428, the blower 428 may be better capable of cooling those devices within the information handling system. During operation, in an embodiment, the blower 428, as optimized, may be running relatively less than other conventional blowers due to the increased ability of the presently-described blower 428 to cool those components within the information handling system.

Figure 5:
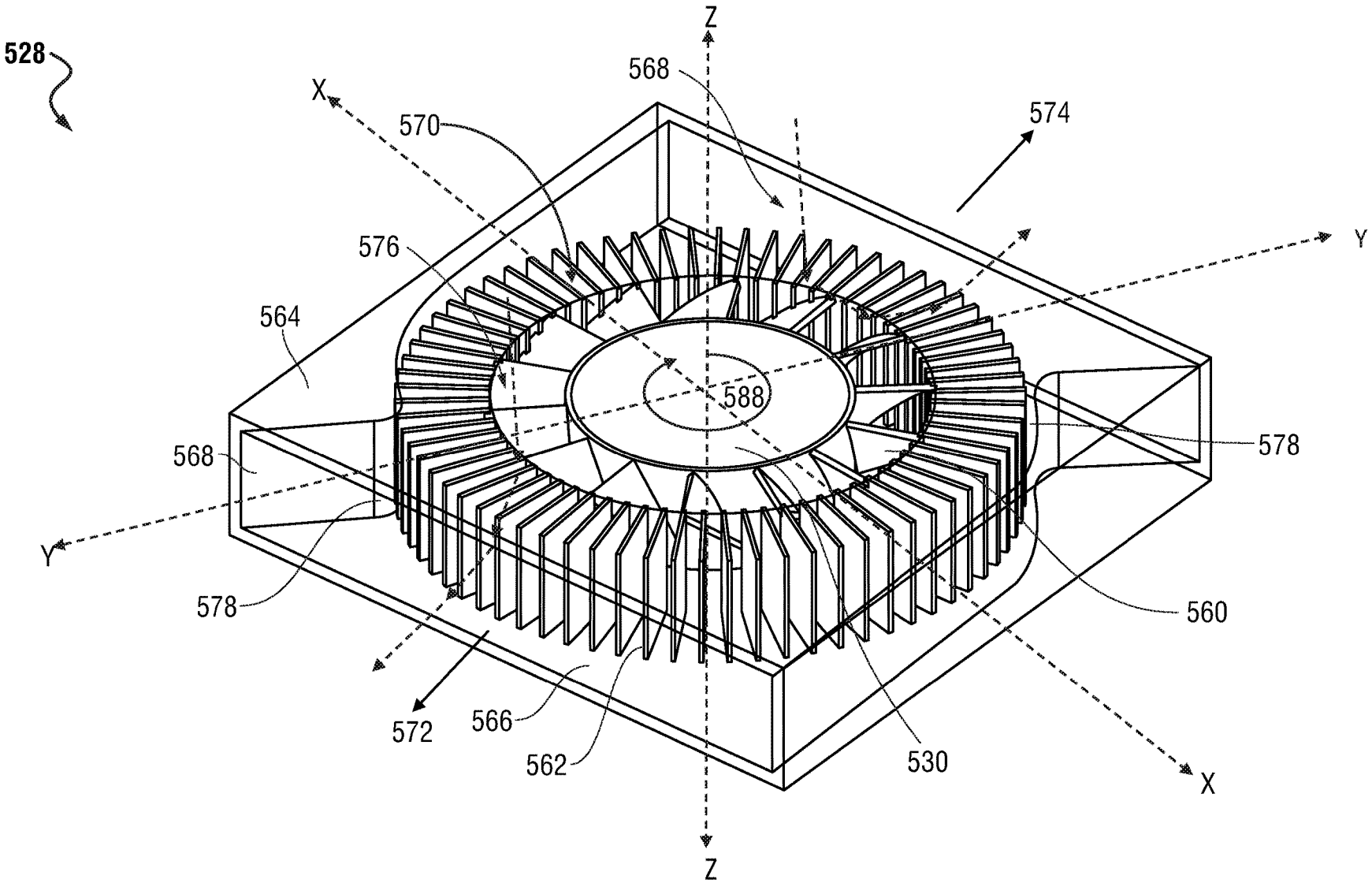
FIG. 5 is a graphical perspective view of a blower system according to another embodiment of the present disclosure.

FIG. 5 is a graphical perspective view of a blower 528 according to another embodiment of the present disclosure. Similar to FIGS. 2-4, the blower 528 includes a housing that includes a top blower housing wall 564 with its air inlet 570, a bottom blower housing wall 566, and two blower housing side walls 568, in this embodiment. Each of the blower housing side walls 568, in an embodiment, include a notch 578 that helps to increase the air pressure created by the rotation of the axial blower blades 560 and centrifugal blower blades 562 as described herein.

During operation, the air is drawn into the blower 528 via air inlet 570. The axial blower blades 560 redirect the airflow 576 of this air to the centrifugal blower blade 562 efficiently so that any air entering the blower 528 parallel to the axis of the central hub 530 is passed to the centrifugal blower blades 562 as soon as possible. The high pressures created by the movement of the axial blower blades 560 causes the airflow 576 to move to the centrifugal blower blades 562 and out one of the first air outlet 572 and second air outlet 574. In the embodiment shown in FIG. 5, the central hub 530, axial blower blades 560, and centrifugal blower blades 562 rotate in a clockwise direction of rotation 588. FIG. 5 also shows that the airflow 576 may be created both at the first air outlet 572 and second air outlet 574 during this rotation exiting the outlet apertures of 572 and 574 in the plane of rotation of the blower system. As can be seen in FIG. 5, an angle of the outer centrifugal blower blades 562 of the outer centrifugal blower blade set is at a greater pitch from a horizontal plane of rotation than a pitch angle of the inner axial blower blades 560 of inner axial blower blade set in various embodiments. In some embodiments, the outer centrifugal blower blades 562 of the outer centrifugal blower blade set is vertical and parallel to an axis of rotation of the blower system fan and central hub 530. Although a specific direction of rotation is described herein, the principles described herein apply equally to a counter-clockwise direction of rotation.

Figure 6:
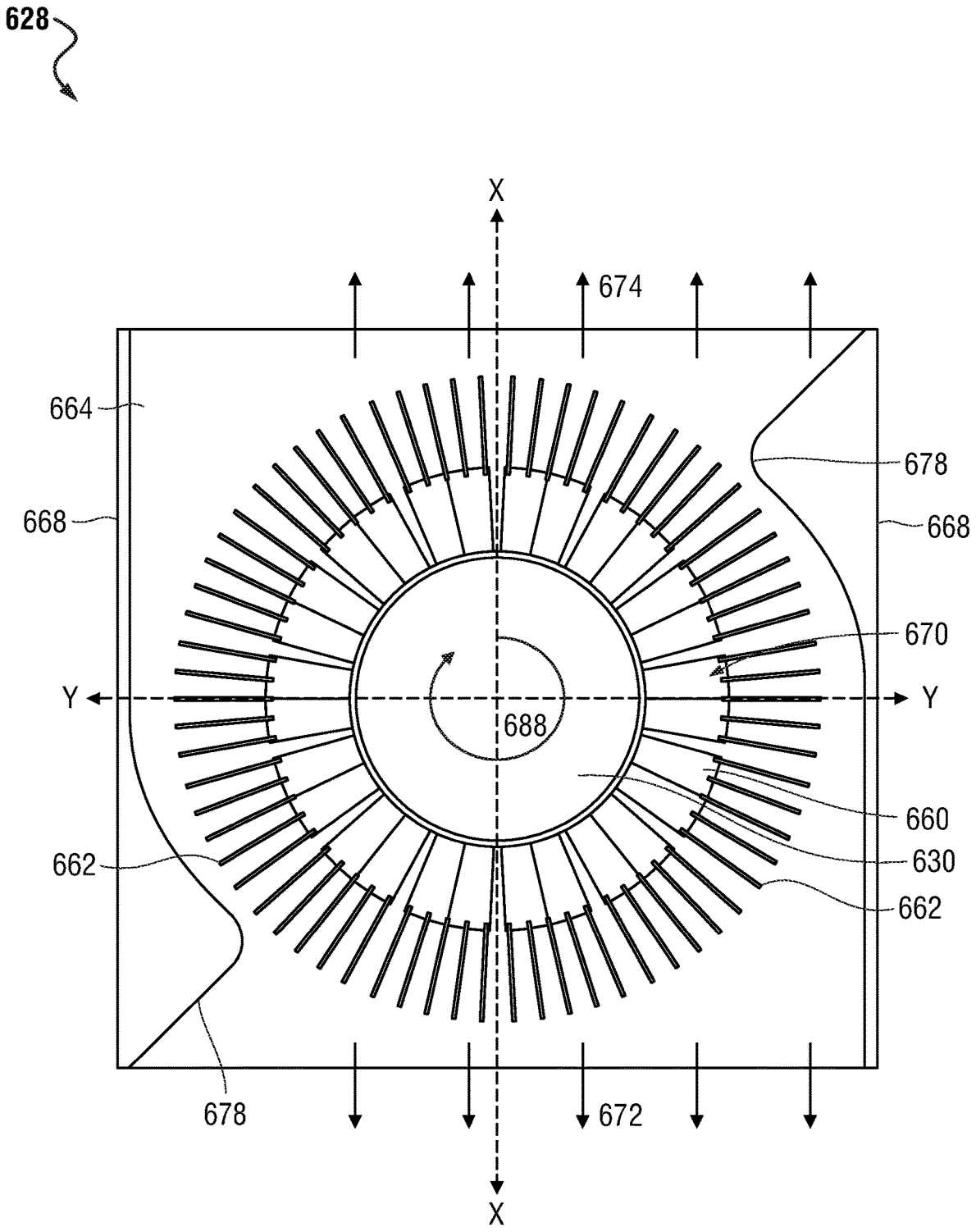
FIG. 6 is a graphical top view of a blower system according to another embodiment of the present disclosure.

FIG. 6 is a graphical top view of a blower 628 according to another embodiment of the present disclosure. Again, the blower 628 includes a housing that includes a top blower housing wall 664 with its air inlet 670 (shown as a cut-out aperture in tope blower housing 664), a bottom blower housing (not shown in FIG. 6), and two blower housing side walls 668, in this embodiment. Each of the blower housing side walls 668 include a notch 678 that helps to increase the air pressure created by the rotation of the axial blower blades 660 and centrifugal blower blades 662 about a central hub 630 as described herein. The notches 678 may formed at a location on the blower housing side walls 668 based on the direction of rotation 688 of the central hub 630 as described herein. FIG. 6 further shows the first air outlet 672 and second air outlet 674 outlet airflow in direction co-planar with the planes of rotation of the outer centrifugal blower blades 662 as well.

FIG. 6 further shows a relative distance between the blower housing side walls 668 and a perimeter of the centrifugal blower blades 662. The distance between the contoured blower housing side walls 668 and notches 678 relative to the perimeter of the centrifugal blower blades 662 may vary depending on a number of factors including, but not limited to, drive power of the blower motor, a target amount of air pressure to be created by the notches 678, and a desired length of the centrifugal blower blades 662 and axial blower blades 660, among others. Again, the present specification contemplates that this distance may be optimized in order to increase the amount of airflow through the blower 628.

Figure 7:
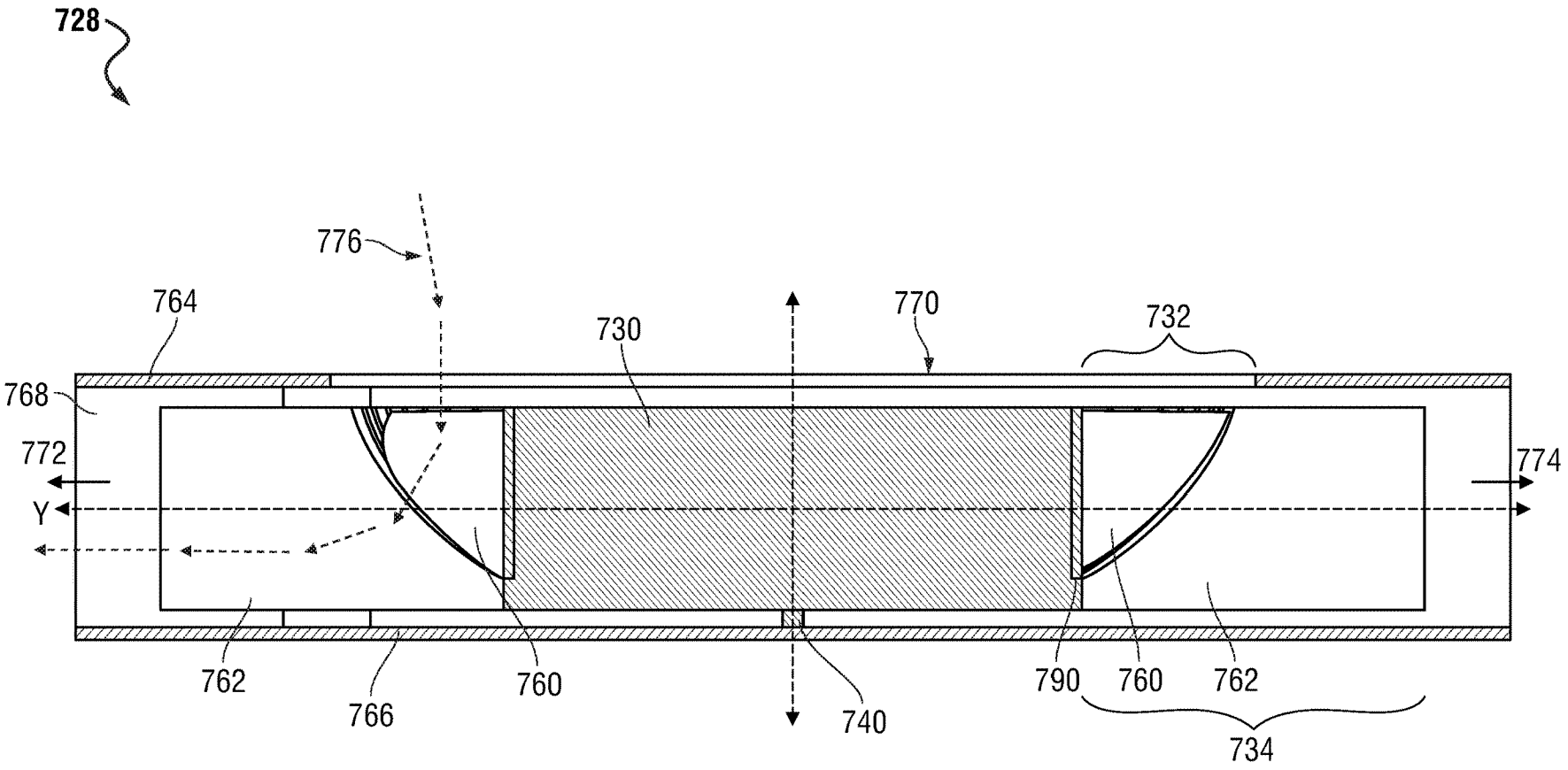
FIG. 7 is a graphical illustration of a side, cut-away view of a blower system according to another embodiment of the present disclosure.

FIG. 7 is a graphical illustration of a side, cut-away view of a blower 728 according to another embodiment of the present disclosure. The blower 728 described in FIG. 7 shows a housing used to house a shaft 740, the central hub 730, the inner axial blower blade set 732, and the outer centrifugal blower blade set 734. This housing is depicted as being separate from any chassis housing or support structures within the information handling system. The present specification contemplates that instead of including a separate housing for the blower 728, any housing structures may be formed within or as part of the base chassis housing parts (e.g., a C-cover or D-cover or other chassis support structures) in carious embodiments. Additionally, the blower 728 described in connection with FIG. 7 may impart certain designs, lengths, widths, or characteristics of the components of the blower 728. However, it is appreciated that these are provided as example embodiments and are not intended to limit the ability of the blower 728 to increase the airflow into and out of the blower 728.

In an embodiment, the housing may include a top blower housing wall 764. The top blower housing wall 764, in an embodiment, may form part of a C-cover of an information handling system or may be, in another embodiment, a distinct part for the blower 728. As shown, the top blower housing wall 764 may include an air inlet 770. The air inlet 770 may provide a fluidic path through which an amount of air may be drawn into the blower 728 through operation of the inner axial blower blade set 732 and outer centrifugal blower blade set 734. In an embodiment, the air inlet 770 may be in the form of a circular cutout in the top blower housing wall 764 and may have a specific radius or other shapes. In an embodiment, the radius of the air inlet 770 may be about equal to a length of the axial blower blades 760 of the inner axial blower blade set 732. In other embodiments, the radius of the air inlet 770 may be greater or less than a length of the axial blower blades 760 of the inner axial blower blade set 732.

In an embodiment, the housing of the blower 728 may include a bottom blower housing wall 766. The bottom blower housing wall 766, in a specific embodiment, may form part of a D-cover of a base portion of an information handling system as described herein. In another embodiment, the bottom blower housing wall 766 may be a distinct housing apart from any part of a housing of an information handling system. In an embodiment, the bottom blower housing wall 766 may include a hole through which a shaft 740 may be passed. The shaft 740 may be coupled to a central hub 730 within the blower 728 to impart a rotational force against the central hub 730 in order to operate the blower 728. The shaft 740 may further be coupled to a blower motor (e.g., blower motor 138, FIG. 1) to transfer the rotational force from that blower motor to the central hub 730.

The housing of the blower 728 may further include one or more blower housing side walls 768 in an embodiment. In some embodiments, any of the blower housing side walls 768 may be part of the C-cover or D-cover of the base portion of an information handling system. The blower housing side walls 768 may define a volume within the blower 728 that the pressure of the air within the blower 728 may be increased due to the operation of the inner axial blower blade set 732 as described herein. In some embodiments, one or more of the blower housing side walls 768 may include a notch 778 that conforms a portion of the blower housing side walls 768 to an exterior edge of the outer centrifugal blower blade set 734. In an embodiment, as the centrifugal blower blades 762 pass the notch 778 at the blower housing side wall 768, the blower 728 may increase air pressure within its housing. A space inside the housing opposite of notch 778 allows for air flow volume to increase such that air may be moved to one or more of the first air outlet 772 or second air outlet 774. In the shown blower 728 of FIG. 7, the air inlet 770 draws air in, is compressed and redirected horizontally as in airflow 776 by the inner axial blower blade set 732 of the blower 728 via spinning the axial blower blades 760 in the clockwise direction with the assistance of the notch 778. In an embodiment, the increased air pressure and efficient airflow redirection created by the inner axial blower blade set 732 as well as the increase in air pressure due to the inclusion of the notch 778, may increase the airflow into and out of the blower 728 thereby increasing the ability of the blower 728 to cool the components of an information handling system. This may also decrease the power consumption of the blower 728.

In a specific embodiment, the blower 728 FIG. 7 and the present disclosure may include two notches, a first notch 778 on a first blower housing side wall 768 and a second notch 778 on a second blower housing side wall 768 arranged opposite the first blower housing side wall 768. These notches 778 may be, in a specific embodiment, a curvilinear shape inside of the blower housing side walls 768 and 724 respectively internal to the first air outlet 772 and second air outlet 774 oppositely arranged to each other. The notches 778 curve from the blower housing side walls 768 such that they form a notch angle. The curvilinear shape may increase inward along the blower housing side walls 768 in the direction of rotation (e.g., clockwise as depicted) of the blower 728 at this notch angle. The curvilinear shape of notches 778 may then be formed to recede to follow the shape of the circumference of the centrifugal blower blades 762 of the outer centrifugal blower blade set 734. This notch angle may be anywhere from 30 to 70 degrees depending upon a notch offset which is offset from an axis of rotation of the blower 728 in some optimized embodiments. In other embodiments, 0 degrees to 90 degrees may be used. There may be no notches 778 or the notches 778 may be of a variety of shapes including angled, pointed, squared off at 90 degrees, or the like in various embodiments. The notch angle and notch offset may define the shape and how far the notches 778 extend from the blower housing side wall 768. Further differing shapes of notches 778 may provide less or greater resistance and air pressurization capability for the blower 728 within the housing or may yield additional noise whereby a shape or size of notch 778 may be determined based upon such factors. Other shapes of notches 778 are contemplated including angled notches 778 with pointed extensions or rounded extensions, rounded notches 778, wavy notches 778, or notches 778 of a variety of shapes or contours. In other embodiments, rotation of the centrifugal blower blades 762 and axial blower blades 760 may be counter-clockwise instead of clockwise as shown. Such reversed direction of the rotation of the blower 728 may result in changed placement of notches 778 in some embodiments. As a consequence of the inclusion of the notches 778 and inner axial blower blade set 732, the air pressure is increased within the housing of the blower 728 thereby further increasing the amount of airflow produced by the blower 728 generally.

As described, in an embodiment, the blower 728 may include a first air outlet 772 and a second air outlet 774 that are fluidically coupled to the air inlet 770. The first air outlet 772 and second air outlet 774 may be opposite each other in a dual opposite outlet blower system embodiment, to allow air to be passed in multiple directions throughout the information handling system. A single air outlet 772 or 774 is also contemplated in some embodiments. During operation of the blower 728, the central hub 730 may be turned by the shaft 740 and the blower motor as described herein. This causes the inner axial blower blade set 732 and outer centrifugal blower blade set 734 to turn as well. In these embodiments, and airflow 776 is created through the blower 728. In a specific embodiment, the form and angle of attack of the axial blower blades 760 of the inner axial blower blade set 732 cause air to be drawn into the blower 728 at an increased speed. Still further the form and angle of attack of the axial blower blades 760 may redirect the airflow 776 down and out towards the centrifugal blower blades 762 of the outer centrifugal blower blade set 734 relatively more efficiently than had the blower 728 included only centrifugal blower blades 762. In these embodiments, the airflow 776 is prevented from accumulating at lower portions of the axial blower blades 760 and centrifugal blower blades 762 causing more efficient transfer of air through the blower 728 and throughout the information handling system. It has been discovered through laboratory experimentation that this dual-piece embodiment that includes the central hub 730/outer centrifugal blower blade set 734 monolithic piece and the inner axial blower blade set 732 produces 14% more airflow in free air resulting in about 12.3 CFM.

Unlike FIGS. 2-6, the inner axial blower blade set 732 and outer centrifugal blower blade set 734 may each be separate pieces. In the embodiments shown and described in connection with FIGS. 7-13, the outer centrifugal blower blade set 734 may be operatively or formed as a portion of the central hub 730. This attachment or coupling may be at a lower portion of the central hub 730. In an embodiment, the outer centrifugal blower blade set 734 and central hub 730 may be formed as a single monolithic piece. This central hub 730/outer centrifugal blower blade set 734 monolithic piece may be formed using a sandcasting process or any other type of manufacturing process including, but not limited to, any additive manufacturing process, any subtractive manufacturing process, any casting process, 3-D printing process, or any injection molding process.

The inner axial blower blade set 732 may include a plurality of axial blower blades 760 operatively coupled to an inner axial blower blade set ring 790. The inner axial blower blade set ring 790 may be placed around the central hub 730 so that the inner axial blower blade set 732 fits within a well formed in a portion of the outer centrifugal blower blade set 734. In this embodiment, a distal end of the axial blower blades 760 may abut with, but not be coupled to, a portion of a proximal end of the centrifugal blower blades 762. Because a portion of the proximal end of the centrifugal blower blades 762 is coupled or formed to the central hub 730, the axial blower blades 760 do not structurally support the centrifugal blower blades 762 like those described in connection with FIGS. 2-6.

In an embodiment, the inner axial blower blade set 732 and the inner axial blower blade set ring 790 may be selectively removed from the central hub 730 and switched out for another inner axial blower blade set 732 and inner axial blower blade set ring 790 that may alter, or better optimize, the airflow produced by the blower 728. The inner axial blower blade set 732 and inner axial blower blade set ring 790 may be coupled to the central hub 730 using any mechanical means. In a specific embodiment, an interior surface of the inner axial blower blade set ring 790 may include a spline that may fit within a keyway formed in the central hub 730. In an alternative embodiment, the hub 730 may include a spline that fits into a keyway formed into the inner axial blower blade set ring 790. The spline and keyway may prevent the relative rotation of the inner axial blower blade set ring 790 to the central hub 730 and instead cause the inner axial blower blade set ring 790 and inner axial blower blade set 732 to rotate with the central hub 730. Other mechanical means used to secure the inner axial blower blade set ring 790 to the central hub 730 may include a compression fit, a screw, a nail, clip, and glue, among others. The two part design (central hub 730/outer centrifugal blower blade set 734 piece and inner axial blower blade set 732 piece) may not only allow for design freedom when optimizing airflow 776 within the blower 728, but also allows provides additional choices regarding how to partition the two pieces with relatively longer or shorter axial blower blades 760 compared to the length of the centrifugal blower blades 762.

Figure 8:
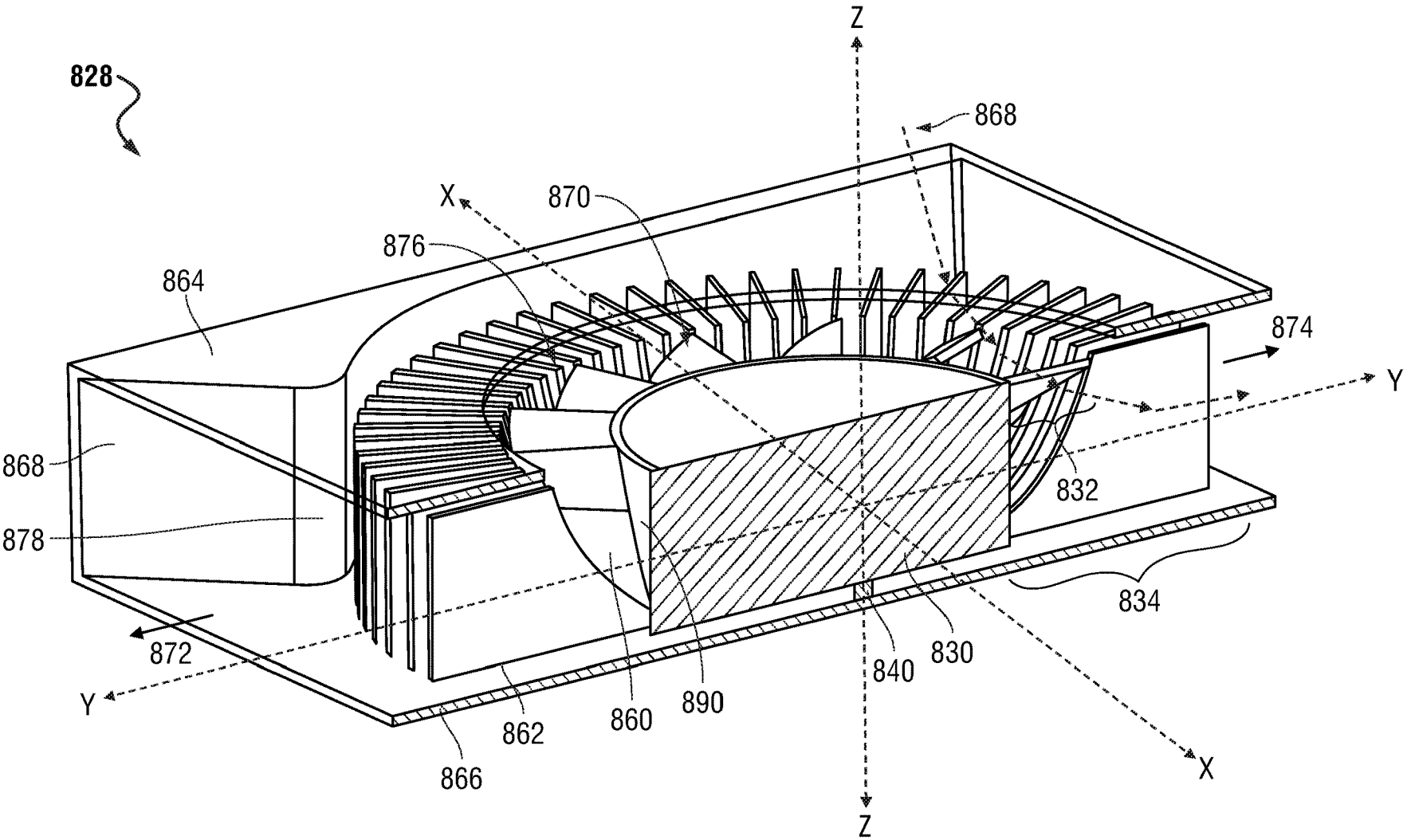
FIG. 8 is a graphical illustration of a perspective, cut-away view of a blower system according to another embodiment of the present disclosure.

FIG. 8 is a graphical illustration of a perspective, cutaway view of a blower 828 according to another embodiment of the present disclosure. FIG. 8 shows more detail of the inner axial blower blade set 832 as a separate piece placed relative to the outer centrifugal blower blade set 834. Additionally, FIG. 8 shows more detail of the placement of the blower housing side wall 868 and notch 878 relative to an outer diameter of the centrifugal blower blades 862 of the outer centrifugal blower blade set 834.

Again, each of the axial blower blades 860 of the inner axial blower blade set 832 may be operatively coupled, at a proximal end, to the central hub 830 via an inner axial blower blade set ring 890 of the blower 828. The central hub 830 may be operatively coupled to a shaft 840 to allow a rotational force from a blower motor to be translated to the central hub 830 during operation of the blower 828. In a specific embodiment, a leading edge in a direction of rotation of a proximal end of the axial blower blades 860 may be flush or nearly flush with a top portion of the inner axial blower blade set ring 890 with a trailing edge of the proximal end of the axial blower blades 860 flush or nearly flush with a bottom of the inner axial blower blade set ring 890. Again, the leading edge of a proximal end of the axial blower blades 860 may be at a position, radially, different than the trailing edge of the proximal end of the axial blower blades 860 such that the axial blower blades 860 are non-vertical relative, radially, to the axis of the central hub 830. This slanting of the axial blower blades 860 causes air to be drawn into the blower 828 and redirected towards the centrifugal blower blades 862 efficiently so as to pass an optimal amount of air through the blower 828 as shown in airflow 876. Airflow 876 is an approximate airflow to illustrate redirection in embodiments herein.

In the embodiment shown in FIG. 8 the centrifugal blower blades 862 are physically coupled or formed to the central hub 830. In this specific embodiment, the central hub 830 and the outer centrifugal blower blade set 834 form a single monolithic piece. As such, the interface between each centrifugal blower blade 862 and one or more of the axial blower blades 860 may include an abutment between the inner axial blower blade set ring 890 and outer centrifugal blower blade 862. As described herein, in an embodiment, a single centrifugal blower blade 862 may abut a plurality of axial blower blades 860. In an embodiment, one or more centrifugal blower blades 862 may abut against one or more axial blower blades 860 as the inner axial blower blade set ring 890 is fitted into a well of the outer centrifugal blower blade set 834.

Similar to FIG. 7, the blower 828 includes a top blower housing wall 864 that has an air inlet 870 formed therein. The housing further includes a bottom blower housing wall 866 and one or more blower housing side walls 868 to encase the blower 828 and provide support, through a shaft 840 for the central hub 830, inner axial blower blade set 832, and outer centrifugal blower blade set 834. Additionally, one or more of the blower housing side walls 868 may include a notch 878 formed thereon to conform to an outer perimeter of the centrifugal blower blades 862 in order to create additional air pressures as described herein. These elements create a path for the airflow 876 to pass in to the air inlet 870, through the inner axial blower blade set 832 and outer centrifugal blower blade set 834, and out one or more of the first air outlet 872 and second air outlet 874. Although the figures described herein show that two air outlets 872, 874 have been formed in the blower 828, the present specification contemplates that a single air outlet may be formed.

Figure 9:
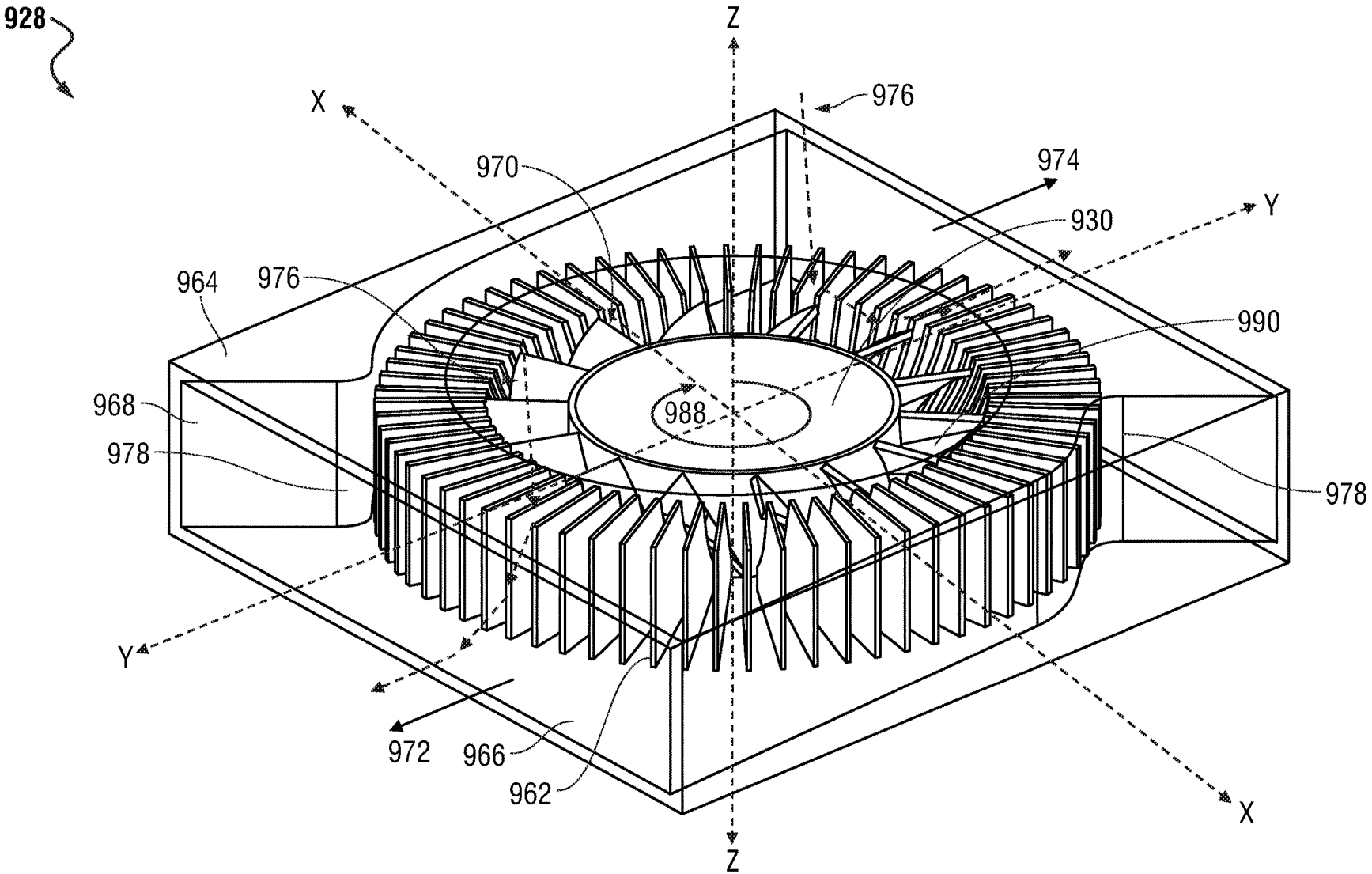
FIG. 9 is a graphical perspective view of a blower system according to another embodiment of the present disclosure.

FIG. 9 is a graphical perspective view of a blower according to another embodiment of the present disclosure. Similar to FIGS. 7 and 8, the blower 928 includes a housing that includes a top blower housing wall 964 with its air inlet 970, a bottom blower housing wall 966, and two blower housing side walls 968, in this embodiment. Each of the blower housing side walls 968 include a notch 978 that helps to increase the air pressure created by the rotation of the axial blower blades 960 and centrifugal blower blades 962 as described herein. Similar to FIG. 7, inner axial blower blade set 932 may include a plurality of axial blower blades 960 operatively coupled to an inner axial blower blade set ring 990. The inner axial blower blade set ring 990 may be placed around the central hub 930 so that the inner axial blower blade set 932 fits within a well formed in a portion of the outer centrifugal blower blade set 934.

During operation, the air is drawn into the blower 928 via air inlet 970. The axial blower blades 960 redirect the airflow 976 of this air to the centrifugal blower blade 962 efficiently so that any air entering the blower 928 parallel to the axis of the central hub 930 is passed to the centrifugal blower blades 962 for radial redirection in the plane of rotation as soon as possible. The high pressures and redirection of airflow 976 created by the movement, pitch, and shape of the axial blower blades 960 causes the airflow 976 to redirect quickly to the centrifugal blower blades 962 and out one of the first air outlet 972 or the second air outlet 974. In the embodiment shown in FIG. 9, the central hub 930, axial blower blades 960, and centrifugal blower blades 962 rotate in a clockwise direction of rotation 988. FIG. 9 also shows that the airflow 976 may be redirected horizontally both at the first air outlet 972 and second air outlet 974 during this rotation by the outer centrifugal blower blades 962.

As can be seen in FIG. 9, an angle of the outer centrifugal blower blades 962 of the outer centrifugal blower blade set is at a greater pitch from a horizontal plane of rotation than a pitch angle of the inner axial blower blades 960 of inner axial blower blade set in various embodiments. In some embodiments, the outer centrifugal blower blades 962 of the outer centrifugal blower blade set is vertical and parallel to an axis of rotation of the blower system fan and central hub 930. Although a specific direction of rotation is described herein, the principles described herein apply equally to a counter-clockwise direction of rotation.

Figure 10:
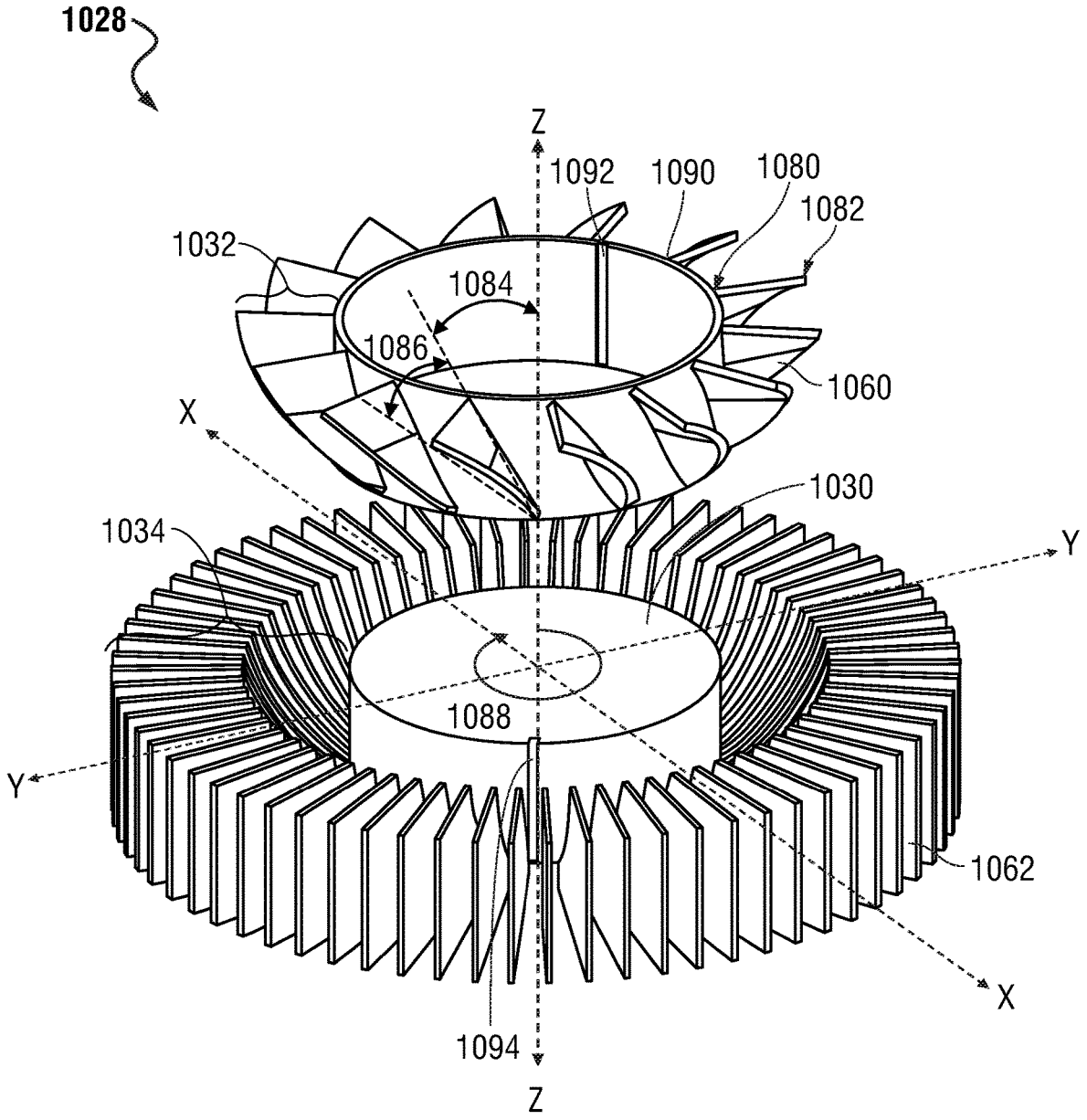
FIG. 10 is a graphical illustration of an exploded, perspective view of a separately formed inner axial blower blade set and an outer centrifugal blower blade set assembled in a blower system according to another embodiment of the present disclosure.

FIG. 10 is a graphical illustration of an exploded, perspective view of an inner axial blower blade set 1032 and outer centrifugal blower blade set 1034 of a blower fan element 1028 according to another embodiment of the present disclosure. FIG. 10 shows the blower fan element 1028 without a housing around it to show the details of the central hub 1030, inner axial blower blade set 1032, and outer centrifugal blower blade set 1034.

FIG. 10 shows, an exploded view of a two-piece embodiment where it can be seen how the individual axial blower blades 1060 will interface with the centrifugal blower blades 1062 when assembled. In this specific embodiment, the central hub 1030 and the outer centrifugal blower blade set 1034 may form a single, monolithic piece with each of the centrifugal blower blades 1062 attached at a lower portion to the central hub 1030. The axial blower blades 1060 are formed to an inner axial blower blade set ring 1090. The axial blower blades 1060 and inner axial blower blade set ring 1090 may be coupled to the central hub 1030 via, in this embodiment, a spline 1092 and a keyway 1094.

As described herein, the axial blower blades 1060 may be non-vertical. In this embodiment, a leading edge in a direction of rotation of the proximal end of axial blower blade 1080 may be coupled to the surface of the inner axial blower blade set ring 1090 at a radial location different from the trailing edge of the proximal end of axial blower blade 1080. This creates an airfoil with the pitch of the axial blower blades 1060 such that air is drawn into the blower 1028.

In an embodiment, a leading edge of a distal end of the axial blower blade 1082 may be located at a position radially similar to the leading edge of the proximal end of axial blower blade 1080. In another embodiment, a leading edge of the distal end of the axial blower blade 1082 may be located at a position radially dissimilar to the leading edge of the proximal end of axial blower blade 1080 reflecting a curvilinear shape or other contour. In this specific embodiment, the axial blower blade 1060 may twist along its length the further the axial blower blade 1060 extends out from the inner axial blower blade set ring 1090 and central hub 1030. In an embodiment, the axial blower blade 1082 may be curved. In this embodiment, the curve of the axial blower blade 1060 may be of any camber of any degree.

FIG. 10 also shows a number of angles 1084 and 1086 describing a pitch of an axial blower blade 1060 according to an embodiment herein. A first angle 1084 indicates a degree of slant of a proximal end of axial blower blade 1080 relative to vertical. A second angle 1086 indicates a degree of slant of a distal end of the axial blower blade 1060 relative to vertical. In this specific embodiment, any difference between the first angle 1084 and second angle 1086 may indicate a twisting of the axial blower blade 1060 from the proximal end of axial blower blade 1080 and the distal end of axial blower blade 1082. This twisting may further cause additional airflow change in directionality or additional air pressure to be created thereby causing more efficient airflow through and out of the blower 1028. In the embodiment shown in FIG. 10, the twisting of the axial blower blades 1060 causes the distal end of axial blower blade 1082 to almost come horizontal. In an embodiment, the axial blower blades 1060 may include an airfoil shape similar to that of a wing so as to more efficiently redirect airflow or to alter the amount of air drawn into the blower 1028.

Although FIGS. 2-13 show specific physical characteristics related to the axial blower blades 1060 (e.g., curved, twisted, slanted, etc.), the present specification contemplates that these specific characteristics may be altered in order to optimize the airflow through and out of the blower 1028. In an embodiment, these specific characteristics may be modified to optimize the air pressure created by the axial blower blades 1060 within the blower 1028 so that airflow is efficiently increased. As these specific characteristics are optimized to optimize the amount of airflow out of the blower 1028, the blower 1028 may be better capable of cooling those devices within the information handling system. During operation, in an embodiment, the blower 1028, as optimized, may be running relatively less than other conventional blowers due to the increased ability of the presently-described blower 1028 to cool those components within the information handling system.

Figure 11:
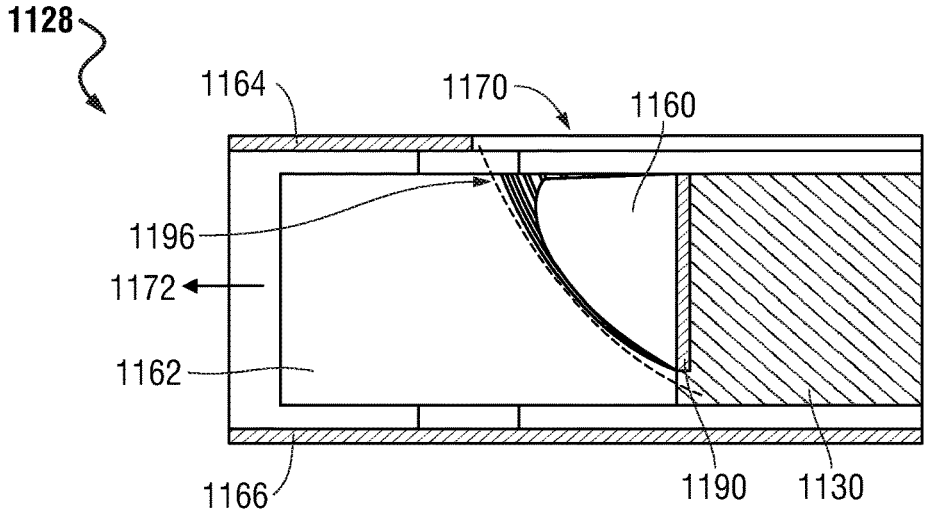
FIG. 11 is a graphical illustration of a side, cut-away view of a separately formed interface between an inner axial blower blade set and an outer centrifugal blower blade set according to another embodiment of the present disclosure.
Figure 12:
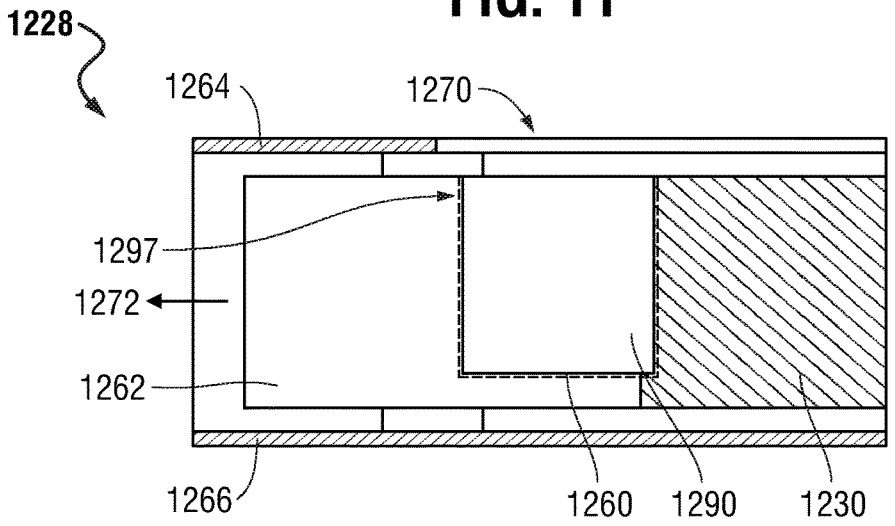
FIG. 12 is a graphical illustration of a side, cut-away view of a separately formed interface between an inner axial blower blade set and an outer centrifugal blower blade set according to another embodiment of the present disclosure.
Figure 13:
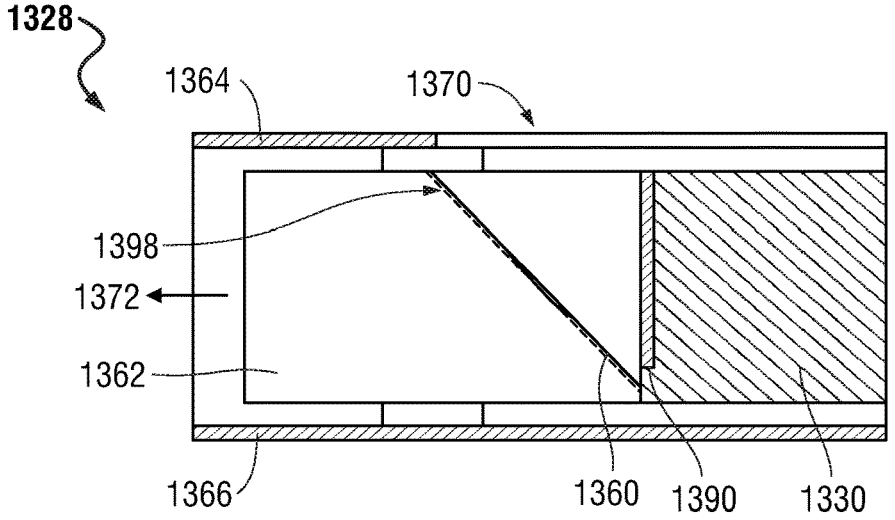
FIG. 13 is a graphical illustration of a side, cut-away view of a separately formed interface between an inner axial blower blade set and an outer centrifugal blower blade set according to another embodiment of the present disclosure.

FIGS. 11-13 are each a graphical illustration of a side, cut-away view of an interface between an inner axial blower blades 1160, 1260, 1360, and an outer centrifugal blower blades 1162, 1262, 1362 according to respective embodiments of the present disclosure. Each of these figures show a portion of a central hub 1130, 1230, 1330, a portion of the top blower housing wall 1164, 1264, 1364, a portion of the bottom blower housing 1166, 1266, 1366, a portion of the air inlet 1170, 1270, 1370 and an air outlet 1172, 1272, 1372. These elements have been described herein in other embodiments and, for brevity will not be described here again.

FIGS. 11-13 show specific interfaces between an inner axial blower blade set having inner axial blower blades 1160, 1260, 1360 with its inner axial blower blade set ring 1190, 1290, 1390 relative to an outer centrifugal blower blade set with its outer centrifugal blower blades 1162, 1262, 1362. In some embodiments, the inner axial blower blade set 1132, 1232, 1332 with its inner axial blower blade set ring 1190, 1290, 1390 may form a monolithic piece while the outer centrifugal blower blade set 1134, 1234, 1334 and central hub 1130, 1230, 1330 also form a monolithic piece. These two monolithic pieces may be coupled together similar to that described in connection with FIGS. 7-10.

FIG. 11 shows a curvilinear interface 1196 between the inner axial blower blades 1160 and the outer centrifugal blower blades 1162. This curvilinear interface 1196 includes a modification of the shape of each of the axial blower blades 1160 of an inner axial blower blade set to abut one or more centrifugal blower blades 1162 of the outer centrifugal blower blade set. In particular, FIG. 11 shows a cross-section of a portion of the inner axial blower blade set ring 1190 and its external curvilinear shape along the curvilinear interface 1196. Further a cross-section of the central hub 1130 and outer centrifugal blower blade set is also shown including the wall formed thereon along curvilinear interface 1196 to fit the inner axial blower blade set ring 1190. In a specific embodiment, a leading edge of a distal end of each of the axial blower blades 1160 may be longer than a trailing edge of the distal end of each of the axial blower blades 1160 in order to abut against the centrifugal blower blades 1162 forming the curvilinear interface 1196.

FIG. 12 shows a squared interface 1297 between the inner axial blower blades 1260 and the outer centrifugal blower blades 1262. This squared interface 1297 includes a modification of the shape of each of the axial blower blades 1260 of the inner axial blower blade set to abut one or more centrifugal blower blades 1262 of the outer centrifugal blower blade set. In particular, FIG. 12 shows a cross-section of a portion of the inner axial blower blade set ring 1290 and its external squared shape along the squared interface 1297. Further a cross-section of the central hub 1230 and outer centrifugal blower blade set is also shown including the wall formed thereon along squared interface 1297 to fit the inner axial blower blade set ring 1290. In a specific embodiment, a leading edge of a distal end of each of the axial blower blades 1260 may be of equal length with the trailing edge of the distal end of each of the axial blower blades 1260 in order to abut against the centrifugal blower blades 1262 forming the squared interface 1297.

FIG. 13 shows a linear slanted interface 1398 between the inner axial blower blades 1360 and the outer centrifugal blower blades 1362. This linear slanted interface 1398 includes a modification of the shape of each of the axial blower blades 1360 of the inner axial blower blade set to abut one or more centrifugal blower blades 1362 of the outer centrifugal blower blade set. In particular, FIG. 13 shows a cross-section of a portion of the inner axial blower blade set ring 1390 and its external slanted shape along the linear slanted interface 1398. Further a cross-section of the central hub 1330 and outer centrifugal blower blade set is also shown including the wall formed thereon along linear slanted interface 1398 to fit the inner axial blower blade set ring 1390. In a specific embodiment, a leading edge of a distal end of each of the axial blower blades 1360 may be of equal length with the trailing edge of the distal end of each of the axial blower blades 1360 in order to abut against the centrifugal blower blades 1362 forming the linear slanted interface 1398.

Figure 14:
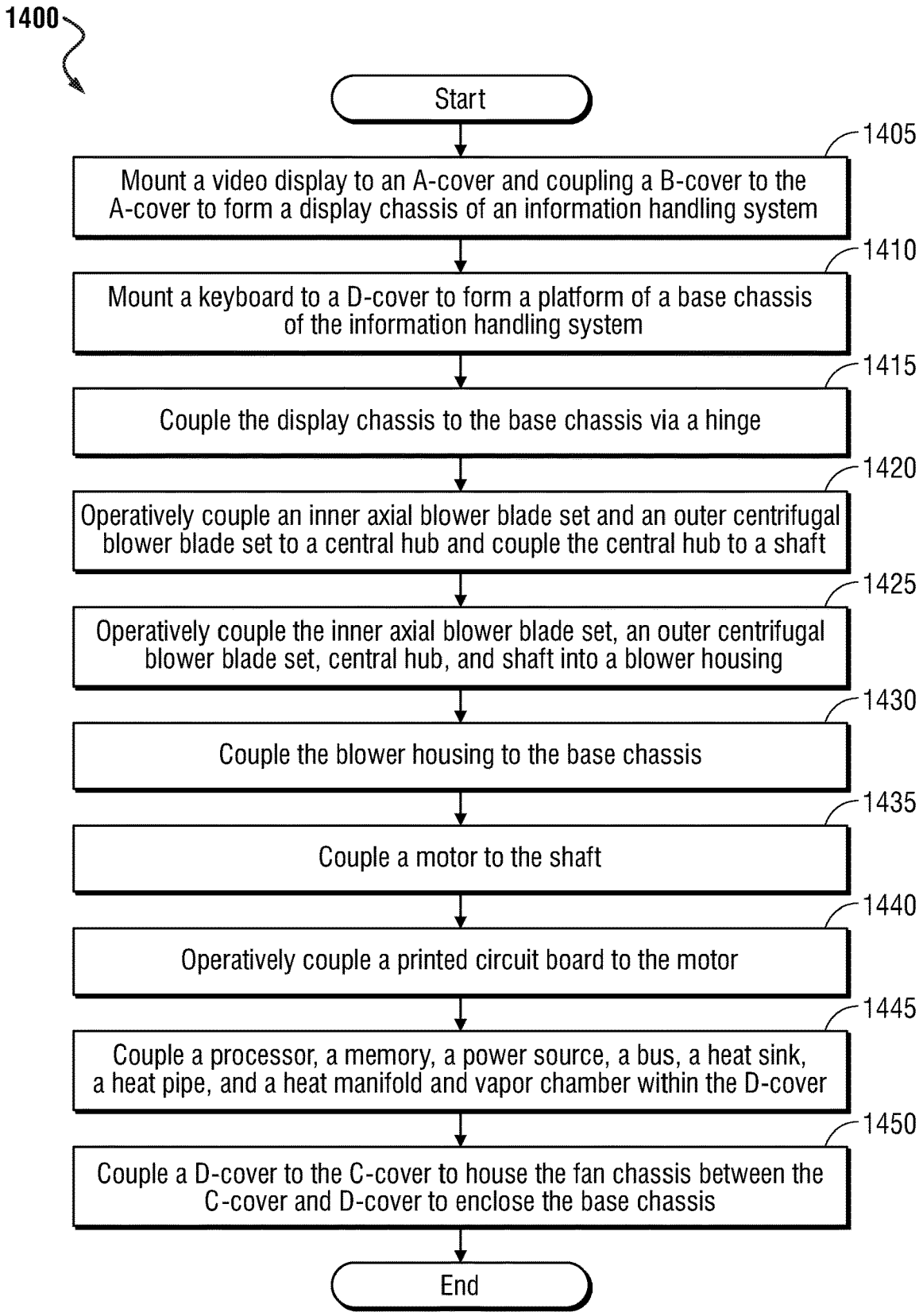
FIG. 14 is a flow diagram illustrating a method of manufacturing an information handling system according to an embodiment of the present disclosure.

FIG. 14 is a flow diagram illustrating a method 1400 of manufacturing an information handling system according to an embodiment of the present disclosure. The method 1400 may begin at block 1405 with mounting a video display to an A-cover and coupling a B-cover to the A-cover to form a display chassis of the information handling system. As described herein, the chassis may include an A-cover functioning to enclose a portion of the information handling system. In an embodiment, a video or digital display device may be supported in the A-cover which may form a back housing for a display chassis. In this embodiment, the chassis may further include a B-cover functioning to enclose the video or digital display device. Here, the A-cover and the B-cover may be joined together in an embodiment to form a fully enclosed display chassis of the laptop-type information handling system. The method 1400 may also include, at block 1410, with mounting a keyboard to a keyboard chassis in a D-cover to the keyboard chassis to form a portion of the base chassis of the information handling system. The chassis may include a D-cover that may serve as a bottom portion of a base housing and support several components of a base chassis housing of an information handling system such as a processor, memory, PMU, thermal cooling system, and blower system, keyboard, touchpad, touchscreen, and any chassis or board in which these components are set into the chassis. The chassis may also include a C-cover to enclose the base housing for the laptop-type information handling system. In some embodiments, the C-cover and D-cover may operate to enclose or house a second display screen or support a large foldable display screen with the display system having a second display screen or a supported, large foldable display screen with the display housing and base housing. These systems may be a dual-screen or foldable screen notebook-type information handling system 100 in some embodiments. In any of these embodiments, the C-cover and the D-cover may be joined together to form a fully enclosed base chassis. The display chassis and the base portion of the chassis may then by coupled together via a hinge at block 1415. This may form a semi-complete information handling system without the C-cover assembled yet to enclose the base chassis thereto in an embodiment.

The method 1400 further includes operatively coupling an inner axial blower blade set and an outer centrifugal blower blade set to a central hub and couple the central hub to the shaft at block 1420. As described herein in an embodiment, the inner axial blower blade set, the outer centrifugal blower blade set, and central hub may be formed into a single monolithic piece. In some embodiments, the method 1400 may also include forming this monolithic piece using, for example, a sandcasting manufacturing method. In this specific embodiment, the geometric characteristics of the blades of the inner axial fan blade set and outer centrifugal fan blade set may be determined during this sandcasting process. Although specific types of manufacturing processes are described herein, the present specification also contemplates that any other type of manufacturing processes may be used to form the hub, inner axial fan blade set, and outer centrifugal fan blade set (either together or separately) including, but not limited to, any additive manufacturing process, any subtractive manufacturing process, any casting process, any 3-D printing process, any injection molding process or some construction of these or other processes understood by those of skill to form plastic or metal fan blades.

In an embodiment, the method 1400 may continue with coupling the shaft to the blower impeller structure in the blower housing at block 1425. The shaft may be coupled to the blower chassis such that the shaft is free to rotate and impart a rotative force to a hub of the blower as described herein. The method 1400 may also include, at block 1425, operatively coupling the inner axial blower blade set, outer centrifugal blower blade set, central hub, and shaft into a blower housing. In an embodiment, the blower housing may include a top blower wall with an air inlet formed therethrough to allow air to pass into the blower system described herein. Additionally, or alternatively, the blower housing may include a bottom blower wall that may include an air inlet formed therethrough to allow air to pass into the blower system described herein. In an embodiment both the top blower wall and bottom blower wall may include an air inlet formed therethrough to allow air to pass into the blower system described herein. The blower housing may further include three or two blower side walls. In the embodiment, where the blower housing includes three blower side walls, the blower system includes a single air outlet at the open wall formed in the blower housing. In the embodiment, where the blower housing includes two blower side walls, the blower system includes two air outlets at the open walls formed in the blower housing. In this embodiment, the two air outlets may be on opposite sides of the blower housing to produce two oppositely moving airflows out of the blower system. In an embodiment, the walls may include a notch that extends a portion of the wall into the housing and along an exterior perimeter of the outer centrifugal fan blade set. The notch may have a curvilinear shape that increases the air pressure of the air and thereby increases the airflow through the blower to one or more air outlets as described herein.

The method 1400 may also include coupling a blower housing to the base chassis at block 1430. In an embodiment, the blower housing may be coupled inside D-cover. In an embodiment, the blower housing may be arranged near other thermal control structures such as the heat pipes, heat sinks, vapor chambers, liquid cooling systems, and any other specific types of passive or active cooling components as part of the thermal cooling system within the information handling system. This arrangement of the blower housing near the thermal control structures is done to place the air outlets for the blower housing as close to these thermal control structures to route more air into, on, or near these thermal control structures. In an embodiment, the air outlets formed in the blower housing may be placed near any chassis air vent outlets formed in the C-cover or D-cover to allow any hot air to pass out of the information handling system. In an embodiment, the air inlets formed in the blower housing to draw air into the blower system may be placed near any chassis air vent inlets formed in the C-cover or D-cover to allow any cool air to be drawn into the information handling system. As described herein, the coupling of a blower chassis may include completed, distinct housing walls and the covers of the base chassis (e.g., C-cover or D-cover) or other structure may serve as any of the housing wall pieces of the blower system housing described herein.

The method 1400 also includes operatively coupling a blower motor to the shaft at block 1435. In an embodiment, a printed circuit board (PCB) may be coupled to the D-cover of the base chassis at block 1440 with the PCB operatively coupled to the motor used to drive the shaft of the blower system. The PCB may be communicatively coupled to a processor or blower controller of the information handling system. In an embodiment, the blower controller may control the operation of the blower motor to drive the rotation of the central hub, the inner axial blower blade set, and the outer centrifugal blower blade set. In a specific embodiment, the PCB may include additional circuitry used to control the speed and actuation of the blower motor with the blower controller sending signals to the circuitry of the PCB as received from the thermal cooling system active detection of heat buildup.

The method 1400 may continue, at block 1445, with coupling a processor, a memory, a power source, a bus, a heat sink, a heat pipe, a heat manifold, and vapor chamber within the C-cover. In this embodiment, the information handling system may include any number of cooling devices as part of the thermal cooling systems within the information handling system. In the example where heat sinks, heat pipes, and vapor chambers are used, the blower may be used and situated within the information handling system so as to create an airflow through the base chassis housing these additional cooling devices. The passage of the airflow over the heat pipes, heat sinks, and vapor chambers directs heat away from the components of the information handling system. In an embodiment, the base chassis may include various airflow passages from the blower, past the heat pipes, heat sinks, and vapor chambers, and out of the base chassis. Heated air may also leave the chassis of the information handling system via exhaust vents situated on the sides, back, C-cover, D-cover, or anywhere in the chassis or system housing as described herein.

The processor, either CPU or GPU, may be thermally coupled to a heat sink, vapor chamber, or other heat mitigation structure in order to draw an amount of heat from the processor. A temperature sensor, such as a thermal couple, may monitor heat levels at the CPU, processor, GPU, power systems, or other heat generating components in the information handling system for the thermal cooling system and blower controller. Other heat sinks may also be included within the base chassis of the information handling system such that the airflow produced by the blower carries away the heat from the heat sinks. The other cooling systems such as the heat pipe and the heat manifold and vapor chamber may also be included within the base chassis and coupled in order to interact with the airflow produced by the blower throughout the information handling system. Such components may be operatively coupled to the D-cover in the base chassis according to methods and techniques understood in the art. Further, the information handling system components, including thermal cooling system components, as well as keyboard or keyboard chassis components, or other I/O device components may be installed in the base chassis in any suitable order. In an embodiment, the C-cover or D-cover of the information handling system may have a number or air inlet vents that allow air from outside of the information handling system to be drawn into the blower housing via the air inlets formed in the top or bottom walls of the blower housing.

At block 1450, the method 1400 includes coupling a D-cover to the C-cover to house the blower between the C-cover and D-cover. At this point the method 1400 may end. The present specification contemplates that the processes described in connection with FIG. 14 may be completed at different times such that the blower system is assembled before it is placed within the information handling system and the chassis of the information handling system is closed to house the blower system housing therein.

Figure 15:
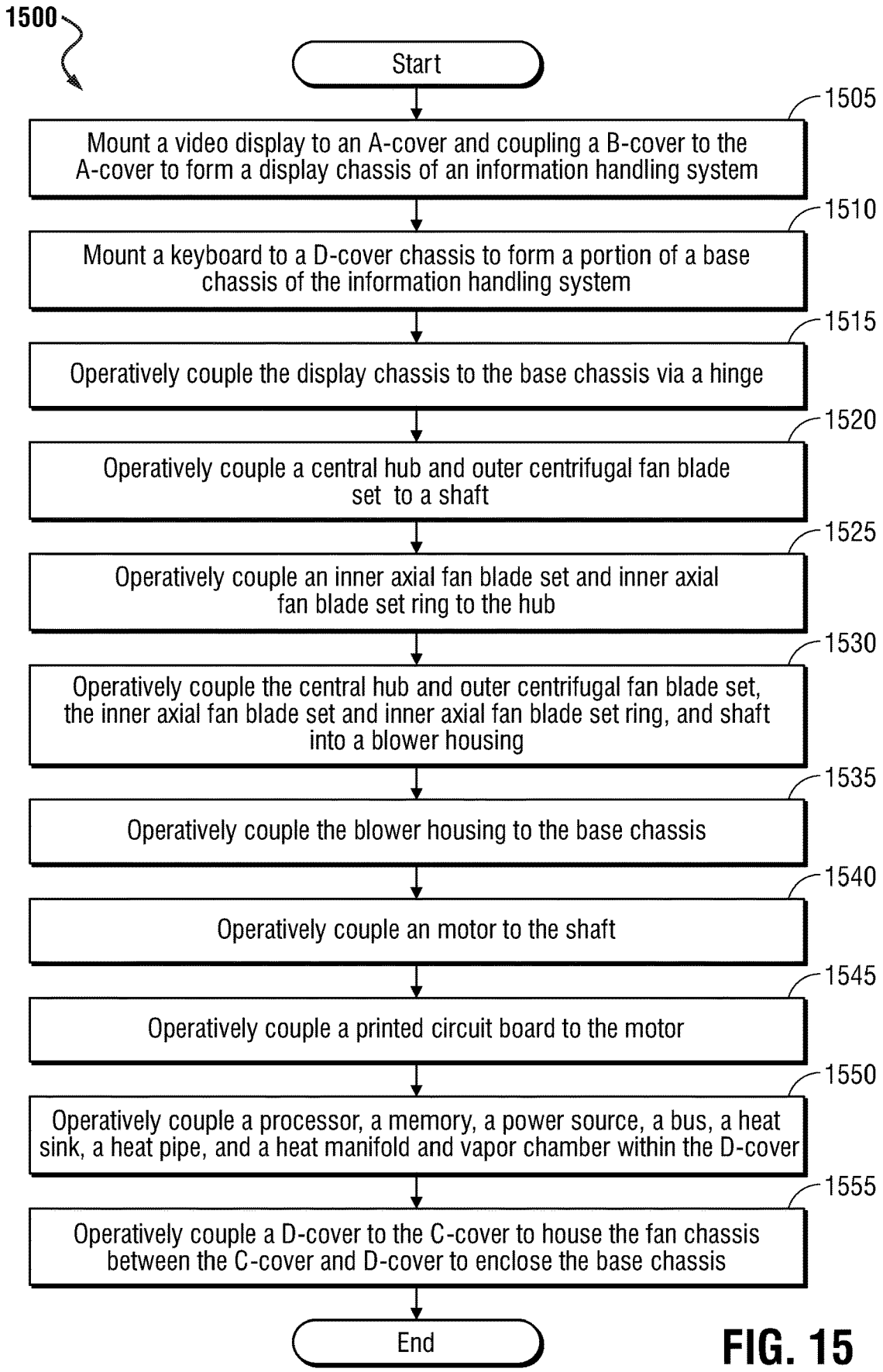
FIG. 15 is a flow diagram illustrating a method of manufacturing an information handling system according to another embodiment of the present disclosure.

FIG. 15 is a flow diagram illustrating a method 1500 of manufacturing an information handling system according to another embodiment of the present disclosure. The method 1500 may begin at block 1505 with mounting a video display to an A-cover and coupling a B-cover to the A-cover to form a display chassis of the information handling system. As described herein, the chassis may include an A-cover functioning to enclose a portion of the information handling system. In this embodiment, the chassis may further include a B-cover functioning to enclose the video or digital display device. Here, the A-cover and the B-cover may be joined together in an embodiment to form a fully enclosed display chassis of the laptop-type information handling system. The method 1500 may also include, at block 1510, with mounting a keyboard to a keyboard chassis and coupling the keyboard chassis to a D-cover to form a portion of the base chassis of the information handling system. Again, the chassis may include the D-cover housing a processor, memory, PMU, thermal cooling system, and blower system, keyboard, touchpad, touchscreen, and any other component or board in which these components are set into the chassis.

The display chassis and the base chassis may then by coupled together via a hinge at block 1515. This may form a semi-complete information handling system without the C-cover assembled thereto at this point in an embodiment. It is understood, however, that the series of steps of assembly of the information handling system may occur according to any known techniques and methods in the art.

The method 1500 further includes, at block 1520 with operatively coupling a central hub and outer centrifugal fan blade set to the shaft. In this embodiment, the central hub and outer centrifugal fan blade set may be formed into a single monolithic piece. This monolithic piece may be formed using an injection molding manufacturing method. In this specific embodiment, the geometric characteristics of the blades of the outer centrifugal blower blade set may be determined prior to the injection molding method using, for example, a computer aided design process to develop a die used to injection mold the outer centrifugal blower blade set. Although specific types of manufacturing processes are described herein, the present specification also contemplates that any other type of manufacturing processes may be used to form the hub and outer centrifugal fan blade set monolithic piece including, but not limited to, any additive manufacturing process, any subtractive manufacturing process, any casting process, any 3-D printing process, or any injection molding process or some construction of these or other processes understood by those of skill to form plastic or metal fan blades.

The method 1500 further includes, at block 1525 with operatively coupling an inner axial fan blade set and inner axial fan blade set ring to the hub. In this embodiment, the inner axial fan blade set and inner axial fan blade set ring may be formed into another, single monolithic piece. This monolithic piece may be formed using, for example, an injection molding manufacturing method. In this specific embodiment, the geometric characteristics of the blades of the inner axial fan blade set may be determined prior to the injection molding method using, for example, a computer aided design process to develop a die used to injection mold the outer centrifugal blower blade set. Although specific types of manufacturing processes are described herein, the present specification also contemplates that any other type of manufacturing processes may be used to form the hub and outer centrifugal fan blade set monolithic piece including, but not limited to, any additive manufacturing process, any subtractive manufacturing process, any casting process, any 3-D printing process, or any injection molding process or some construction of these or other processes understood by those of skill to form plastic or metal fan blades. The inner axial fan blade set and inner axial fan blade set ring when coupled to the hub may nestingly fit into a well formed in the central hub and outer centrifugal fan blade single monolithic piece. The external shape of the inner axial fan blade set may be curved, squared, slanted or any other shape and may correspond to a similar shape of the well formed in the outer centrifugal fan blades of the outer centrifugal fan blade single monolithic piece in various embodiments.

In an embodiment, an interior surface of the inner axial blower blade set ring may include a spline that may fit within a keyway formed in the central hub. This spline and keyway may prevent the relative rotation of the inner axial blower blade set ring to the central hub and instead cause the inner axial blower blade set ring and inner axial blower blade set to rotate with the central hub. Other mechanical means used to secure the inner axial blower blade set ring to the central hub may include a compression fit, a screw, a nail, and glue, among others.

The method may further include, at block 1530, with operatively coupling the central hub and outer centrifugal fan blade set, the inner axial fan blade set, and inner axial fan blade set ring, and shaft into a blower housing. In an embodiment, the blower housing may include a top blower wall with an air inlet formed therethrough to allow air to pass into the blower system described herein. Additionally, or alternatively, the blower housing may include a bottom blower wall that may include an air inlet formed therethrough to allow air to pass into the blower system described herein. In an embodiment both the top blower wall and bottom blower wall may include an air inlet formed therethrough to allow air to pass into the blower system described herein. The blower housing may further include one or more blower side walls, and this may depend on the shape of the blower system housing and the number of air outlet apertures in the blower housing. In the embodiment, where the blower housing includes three blower side walls, the blower system includes a single air outlet at one open wall formed in the blower housing. In an embodiment where the blower housing includes two blower side walls, the blower system includes two air outlets at open walls formed in the blower housing. In one embodiment, the two air outlets may be on opposite sides of the blower housing to produce two oppositely moving airflows out of the blower system. In an embodiment, the walls may include a notch that extends a portion of the wall into the housing and along an exterior perimeter of the outer centrifugal fan blade set. The notch may have a curvilinear shape that increases the air pressure of the air and thereby increases the airflow through the blower to one or more air outlets as described herein.

The method 1500 may also include coupling a blower chassis to the base chassis at block 1535. In an embodiment, the blower housing may be coupled inside D-cover. In an embodiment, the blower housing may be arranged near other thermal control structures such as the heat pipes, heat sinks, vapor chambers, liquid cooling systems, and any other specific types of passive or active cooling components as part of the thermal cooling system within the information handling system. This arrangement of the blower housing near the thermal control structures is done to place the air outlets for the blower housing as close to these thermal control structures to route more air into, on, or near these thermal control structures. In an embodiment, the air outlets formed in the blower housing may be placed near any chassis air outlets formed in the C-cover or D-cover to allow any hot air to pass out of the information handling system. As described herein, the coupling of a blower chassis may not be completed and the covers of the base chassis (e.g., C-cover or D-cover) or other structure may serve as any of the housing pieces of the blower system described herein.

The method 1500 also includes operatively coupling a blower motor to the shaft at block 1540. As described, the shaft may be coupled to the blower chassis such that the shaft is free to rotate and impart a rotative force to a hub of the blower as described herein.

The method 1500 may further include, at block 1545, operatively coupling a printed circuit board to the motor. The PCB may be communicatively coupled to a processor or blower controller of the information handling system. In an embodiment, the blower controller may control the operation of the blower motor to drive the rotation of the central hub, the inner axial blower blade set, and the outer centrifugal blower blade set. In a specific embodiment, the PCB may include additional circuitry used to control the speed and actuation of the blower motor with the blower controller sending signals to the circuitry of the PCB. The PCB, blower controller, and other thermal cooling system logic or integrated circuits may operate in coordination with a PMU as an active and passive thermal cooling system in various embodiments.

The method 1500 may further include, at block 1550, with coupling a processor, a memory, a power source, a bus, a heat sink, a heat pipe, a heat manifold, and vapor chamber within the D-cover. In this embodiment, the information handling system may include any number of cooling devices as part of the thermal cooling systems within the information handling system. In the example where heat sinks, heat pipes, and vapor chambers are used, the blower may be used and situated within the information handling system so as to create an airflow through the base chassis housing these additional cooling devices. The passage of the airflow over the heat pipes, heat sinks, and vapor chambers directs heat away from the components of the information handling system. In an embodiment, the base chassis may include various airflow passages from the blower, past the heat pipes, heat sinks, and vapor chambers, and out of the base chassis. Heated air may also leave the chassis of the information handling system via exhaust vents situated on the sides, back, C-cover, D-cover, or anywhere in the chassis or system housing as described herein. Such components may be operatively coupled to the D-cover in the base chassis according to methods and techniques understood in the art. Further, the information handling system components, including thermal cooling system components, as well as keyboard or keyboard chassis components, or other I/O device components may be installed in the base chassis in any suitable order.

The processor, either CPU or GPU, may be thermally coupled to a heat sink, vapor chamber, or other heat mitigation structure in order to draw an amount of heat from the processor. A temperature sensor, such as a thermal couple, may monitor heat levels at the CPU, processor, GPU, power systems, or other heat generating components in the information handling system for the thermal cooling system and blower controller. Other heat sinks may also be included within the base chassis of the information handling system such that the airflow produced by the blower carries away the heat from the heat sinks. The other cooling systems such as the heat pipe and the heat manifold and vapor chamber may also be included within the base chassis and coupled in order to interact with the airflow produced by the blower throughout the information handling system.

At 1555, the chassis may also include a C-cover to enclose the base housing for the laptop-type information handling system. In some embodiments, the C-cover and D-cover may operate to enclose or house the components and thermal cooling system aspects as described above. The C-cover may further support and provide for a keyboard, touchpad or other I/O devices to be available to a user in embodiments. In some embodiments, the C-cover may support a second display screen or support a large foldable display screen with the display system having a second display screen or a supported, large foldable display screen with the display housing and base housing. These systems may be a dual-screen or foldable screen notebook-type information handling system 100 in some embodiments. In any of these embodiments, the C-cover and the D-cover may be joined together to form a fully enclosed base chassis. In an embodiment, the C-cover or D-cover of the information handling system may have a number or air inlet vents that allow air from outside of the information handling system to be drawn into the blower housing via the air inlets formed in the top or bottom walls of the blower housing. Upon coupling a D-cover to the C-cover to house the blower between the C-cover and D-cover at 1555, at this point the method 1500 may end. The present specification contemplates that the processes described in connection with FIG. 15 may be completed at different times such that the blower system is placed within the information handling system and the chassis of the information handling system is closed to house the blower housing therein.

The blocks of the flow diagrams of FIGS. 14 and 15 or steps and aspects of the operation of the embodiments herein and discussed herein need not be performed in any given or specified order. It is contemplated that additional blocks, steps, or functions may be added, some blocks, steps or functions may not be performed, blocks, steps, or functions may occur contemporaneously, and blocks, steps or functions from one flow diagram may be performed within another flow diagram.

Devices, modules, resources, or programs that are in communication with one another need not be in continuous communication with each other, unless expressly specified otherwise. In addition, devices, modules, resources, or programs that are in communication with one another can communicate directly or indirectly through one or more intermediaries.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The subject matter described herein is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents and shall not be restricted or limited by the foregoing detailed description.

What is claimed is:

1. An information handling system, comprising:

a processor, a memory, and a power source operatively coupled in a base chassis;

a blower system including:

a shaft operatively coupled to a blower motor;

a hub operatively coupled to the shaft;

a blower housing having an air inlet a first wall of the blower housing and closed on the opposite side of the blower housing; and an impeller with an outer centrifugal blower blade set forming a monolithic piece with an inner axial blower blade set and hub, where the outer centrifugal blades of the outer centrifugal blower blade set join the hub below inner axial blades of the inner axial blower blade set operatively coupled to the hub; and the inner axial blower blade set is set into the outer centrifugal blower blade set such that the bottom of the inner axial blower blade set axially overlaps the outer centrifugal blower blade set at a junction with the hub above the bottom of the hub to redirect an incoming airflow via the air inlet in the blower housing to the outer centrifugal blower blade set and air outlet in the blower housing, where an inlet flow direction is orthogonal to the plane of rotation of the blower system into the inlet in the blower housing and the airflow is redirected to an outlet airflow direction out of a side air outlet in the plane of rotation of the blower system.

2. The information handling system of claim 1, further comprising:

the air inlet formed in the first wall that is either a top wall or bottom wall of the blower housing such that the incoming airflow enters in a direction normal to the outlet airflow.

3. The information handling system of claim 1, further comprising:

the blower housing to house the inner axial blower blade set and outer centrifugal blower blade set, the blower including a notch in a portion of a wall of the blower housing to conform to an outer edge of the outer centrifugal blower blade set.

4. The information handling system of claim 1, further comprising:

the side air outlet directing air away from the hub in a first direction and a second side air outlet directing air away from the hub in a second and opposite direction from the first direction.

5. The information handling system of claim 1, wherein the inner axial blower blade set further comprises a plurality of inner axial blower blades that extend from the hub at a first angle with a first edge of a proximal end of each of the inner axial blower blades leading a second edge of the proximal end of each of the inner axial blower blades in a direction of rotation of the inner axial blower blade set.

6. The information handling system of claim 1, wherein the inner axial blower blade set further comprises a plurality of inner axial blower blades wherein a proximal end of each of the inner axial blower blades are curved.

7. The information handling system of claim 1, further comprising:

the inner axial blower blade set includes a plurality of inner axial blower blades; and the inner axial blower blades extend from the hub at a first angle with a first edge of a proximal end of each of the inner axial blower blades leading a second edge of each of the inner axial blower blades in a direction of rotation, wherein the first angle of the inner axial blower blades is at a greater angle from vertical than the outer centrifugal blower blades of the outer centrifugal blower blade set.

8. The information handling system of claim 1, wherein the outer centrifugal blower blade set further comprises a plurality of outer centrifugal blower blades with each of the outer centrifugal blower blades being parallel relative to a vertical center axis of the hub.

9. An information handling system, comprising:

a processor, a memory, a thermal cooling system, and a power source operatively coupled to a base chassis;

a blower system including:

a shaft;

a hub operatively coupled to the shaft;

an impeller with an outer centrifugal blower blade set formed to the hub of the impeller and forming a monolithic piece with the hub;

an inner axial blower blade set operatively coupled to the hub where the inner axial blower blade set is a separately formed piece nested into the outer centrifugal blower blade set such that the inner axial blower blade set is set into the outer centrifugal blower blade set such that the bottom of the inner axial blower blade set axially overlaps the outer centrifugal blower blade set at a junction on the hub, where the outer centrifugal blades of the outer centrifugal blower blade set join the hub below inner axial blades of the inner axial blower blade set operatively coupled to the hub; and the inner axial blower blade set is angled to increase the redirection of an incoming airflow to the outer centrifugal blower blade set within the impeller and an air outlet in a blower housing, where the outlet airflow direction is in a plane of rotation for the inner axial blower blade set and the outer centrifugal blower blade set.

10. The information handling system of claim 9, the inner axial blower blade set further comprises an inner axial blower blade set ring as the separately formed piece with the inner axial blower blade set ring being operatively coupled to the hub via a spline.

11. The information handling system of claim 9, further comprising:

a blower housing to house the inner axial blower blade set and outer centrifugal blower blade set, the housing comprising a notch in a portion of a wall of the housing to conform to an outer edge of the outer centrifugal blower blade set.

12. The information handling system of claim 9, further comprising a first air outlet directing air away from the hub in a first direction and a second air outlet directing air away from the hub in a second and opposite direction from the first direction.

13. The information handling system of claim 9, wherein the inner axial blower blade set further comprises a plurality of inner axial blower blades that extend from the hub at a first angle with a first edge of a proximal end of each of the inner axial blower blades leading a second edge of the proximal end of each of the inner axial blower blades in a direction of rotation of the inner axial blower blade set.

14. The information handling system of claim 9, wherein the inner axial blower blade set further comprises a plurality of inner axial blower blades wherein a proximal end of each of the inner axial blower blades are curved.

15. The information handling system of claim 9, wherein an angle of the outer centrifugal blower blades of the outer centrifugal blower blade set is at a greater pitch from a horizontal plane of rotation than a pitch angle of the inner axial blower blades of inner axial blower blade.

16. A method of assembling an information handling system with a powered blower, comprising:

operatively coupling a central processor, a memory, thermal cooling system, and a power source in an information handling system chassis;

assembling a blower system formed by:

molding an impeller with a plurality of inner axial blower blades of an inner axial blower blade set and an inner axial blower blade set ring to form an inner axial blower blade set;

molding the impeller with a plurality of outer centrifugal blower blades of an outer centrifugal blower blade set to a central hub; and operatively coupling the inner axial blower blade set ring to the central hub via a spline such that the inner axial blower blade set is nested into the outer centrifugal blower blades such that the bottom of the inner axial blower blade set axially overlaps the outer centrifugal blower blade set on a junction with the hub to form the impeller, where the outer centrifugal blades of the outer centrifugal blower blade set join the hub below inner axial blades of the inner axial blower blade set operatively coupled to the hub;

mounting the inner axial blower blade set, outer centrifugal blower blade set, and hub of the impeller to a shaft operatively coupled to a motor of the blower;

forming a blower housing around the inner axial blower blade set and outer centrifugal blower blade set including any inlet in a top or bottom housing wall and an airflow outlet along a side of the blower housing;

mounting the blower system in the information handling system chassis and operatively coupling the power source to a motor of the blower system; and operatively coupling a blower controller of the thermal cooling system to the power source and the motor to direct the activation of the blower system.

17. The information handling system of claim 16, wherein the inner axial blower blades are formed having a first edge of a proximal end of each of the inner axial blower blades leading a second edge of the proximal end of each of the inner axial blower blades in a direction of rotation.

18. The information handling system of claim 16, wherein the inner axial blower blades are molded to have a curved proximal end.

19. The information handling system of claim 16, the outer centrifugal blower blades are molded to be vertical relative to a vertical center axis of the hub.

20. The information handling system of claim 16, wherein the outer centrifugal blower blades are molded to have a pitch from a horizontal plane or rotation greater than the inner axial blower blades.

* * * * *